US010569559B2

(12) United States Patent
Hanaoka et al.

(10) Patent No.: US 10,569,559 B2
(45) **Date of Patent: *Feb. 25, 2020**

(54) LIQUID EJECTING APPARATUS

(71) Applicant: SEIKO EPSON CORPORATION, Tokyo (JP)

(72) Inventors: Yukihiro Hanaoka, Shiojiri (JP); Takuya Okina, Shiojiri (JP); Eiichiro Watanabe, Matsumoto (JP); Masaru Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 74 days.

This patent is subject to a terminal disclaimer.

(21) Appl. No.: 15/816,909

(22) Filed: Nov. 17, 2017

(65) Prior Publication Data

US 2018/0162139 A1 Jun. 14, 2018

(30) Foreign Application Priority Data

Dec. 8, 2016 (JP) ..... 2016-238822

(51) Int. Cl.
*B41J 2/175* (2006.01)
*B41J 2/165* (2006.01)
*B41J 2/19* (2006.01)

(52) U.S. Cl.
CPC ..... *B41J 2/17596* (2013.01); *B41J 2/1652* (2013.01); *B41J 2/16508* (2013.01); *B41J 2/16538* (2013.01); *B41J 2/175* (2013.01); *B41J 2/17563* (2013.01); *B41J 2/19* (2013.01)

(58) Field of Classification Search
CPC .. B41J 2/17596; B41J 2/16508; B41J 2/1652; B41J 2/16538; B41J 2/175; B41J 2/17563; B41J 2/19
See application file for complete search history.

(56) References Cited

U.S. PATENT DOCUMENTS 5,886,718 A * 3/1999 Johnson ..... B41J 2/17509 347/85
2008/0218554 A1 9/2008 Inoue
2010/0321425 A1 12/2010 Kanke et al.
2011/0193918 A1 8/2011 Kobashi et al.
2012/0056933 A1* 3/2012 Tanaka ..... B41J 2/16508 347/30
2015/0091977 A1 4/2015 Sugiura et al.
2016/0016407 A1 1/2016 Nagase et al.
(Continued)

FOREIGN PATENT DOCUMENTS

JP H10-129007 5/1998
JP H11-129502 5/1999
(Continued)

*Primary Examiner* — Manish S Shah
(74) *Attorney, Agent, or Firm* — Workman Nydegger

(57) ABSTRACT

A liquid ejecting apparatus includes a liquid ejecting head having nozzles and an opening surface through which the nozzles are opened, the liquid ejecting head being configured to eject liquid from the nozzles, a supply flow path configured to supply the liquid to the liquid ejecting head, a pressurizing mechanism that can pressurize the inside of the supply flow path, an opening/closing mechanism that can open and close the supply flow path, and a control unit that controls operations of the liquid ejecting head, the pressurizing mechanism, and the opening/closing mechanism.

10 Claims, 11 Drawing Sheets

(56) References Cited

U.S. PATENT DOCUMENTS

| | | | | |
|---|---|---|---|---|
| 2017/0182765 | A1* | 6/2017 | Shimazu | B41J 2/16508 |
| 2018/0009231 | A1* | 1/2018 | Yokozawa | B41J 2/17596 |
| 2018/0056664 | A1* | 3/2018 | Koike | B41J 2/17509 |
| 2018/0072069 | A1* | 3/2018 | Hara | B41J 2/04541 |
| 2018/0086094 | A1* | 3/2018 | Sakai | B41J 2/01 |

FOREIGN PATENT DOCUMENTS

| | | | |
|---|---|---|---|
| JP | 2006-150745 | A | 6/2006 |
| JP | 2008-221534 | | 9/2008 |
| JP | 2009-082806 | | 4/2009 |
| JP | 2011-005672 | | 1/2011 |
| JP | 2011-161686 | A | 8/2011 |
| JP | 2011-173361 | | 9/2011 |
| JP | 2012-051274 | | 3/2012 |
| JP | 2012-116144 | A | 6/2012 |
| JP | 51-14229 | | 1/2013 |
| JP | 2013-121712 | | 6/2013 |
| JP | 2015-066717 | | 4/2015 |
| JP | 2016-020081 | A | 2/2016 |
| JP | 2016-129956 | A | 7/2016 |

* cited by examiner

LIQUID EJECTING APPARATUS

BACKGROUND

1. Technical Field

The present invention relates to a liquid ejecting apparatus such as a printer.

2. Related Art

As an example of a liquid ejecting apparatus, there is an ink jet type printer configured to start supplying ink after precompressing a buffer tank in advance when supplying ink to a recording head through the buffer tank (for example, JP-A-2006-150745).

SUMMARY

When pressurizing a liquid to be supplied to a recording head, ink may flow out of nozzles and be wasted until the pressure falls. An advantage of some aspects of the invention is to provide a liquid ejecting apparatus that can prevent liquid from unnecessarily flowing out due to pressurization.

The liquid ejecting apparatus includes a liquid ejecting head configured to have nozzles and an opening surface, where the nozzles open, and eject liquid from the nozzles, a supply flow path arranged so as to supply the liquid to the liquid ejecting head, a pressurizing mechanism that can pressurize the inside of the supply flow path, an opening/closing mechanism that can open and close the supply flow path, and a control unit that controls operations of the liquid ejecting head, the pressurizing mechanism, and the opening/closing mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the liquid ejecting apparatus will be described with reference to the drawings. The liquid ejecting apparatus is, for example, an ink jet type printer that performs recording (printing) by ejecting ink that is an example of liquid to a medium such as a paper sheet.

First Embodiment

Figure 1:
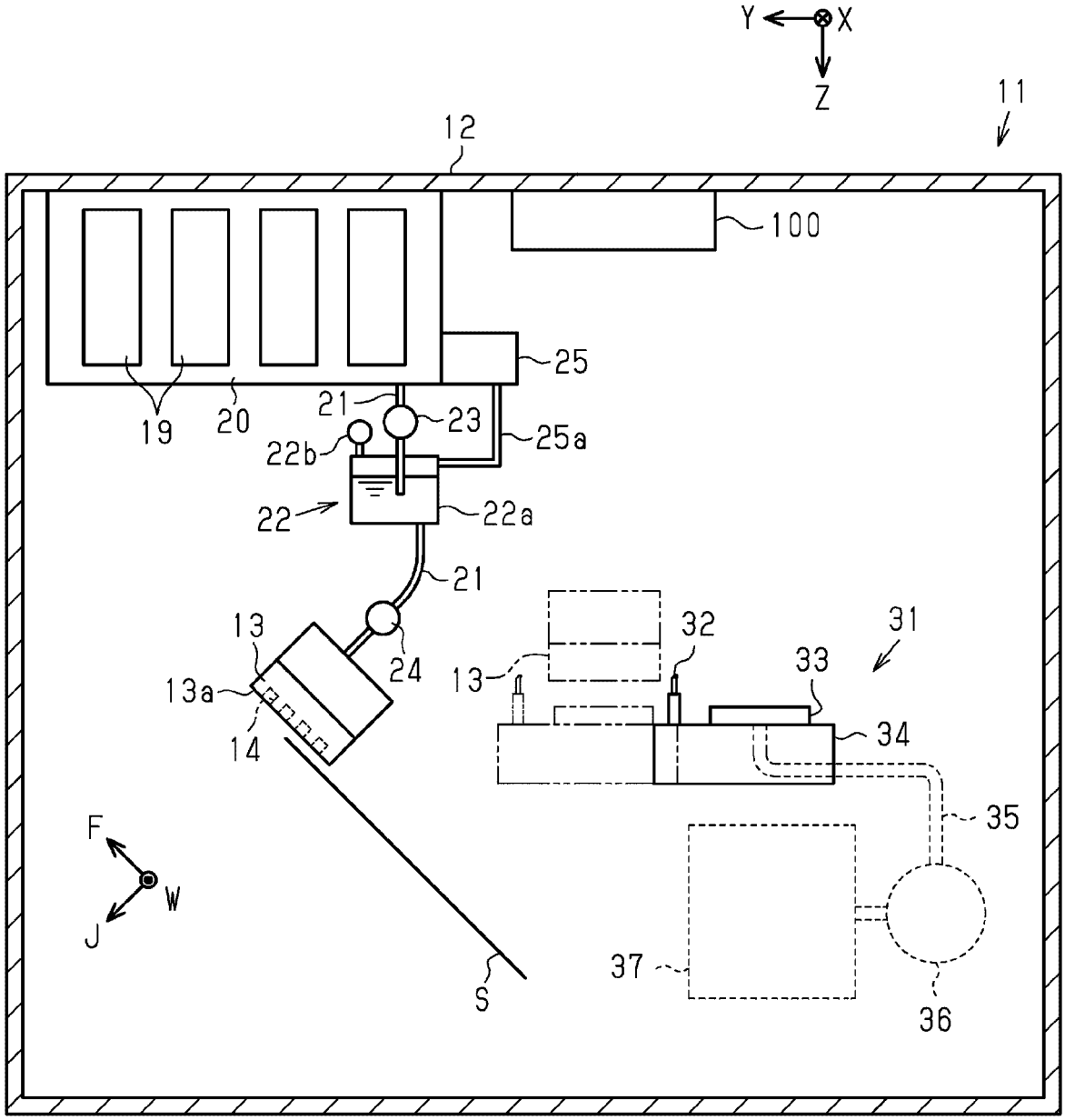
FIG. 1 is an entire configuration diagram of a liquid ejecting apparatus of a first embodiment.

As shown in FIG. 1, a liquid ejecting apparatus 11 of the present embodiment includes a housing 12, a liquid ejecting head 13 that ejects liquid in the housing 12, and a maintenance apparatus 31 that performs maintenance of the liquid ejecting head 13. The liquid ejecting head 13 is configured to have nozzles 14 and an opening surface 13*a*, where the nozzles 14 open, and eject liquid from the nozzles 14. The liquid ejecting head 13 is configured to be displaceable to a first posture shown by a solid line in FIG. 1 and a second posture shown by a chain double-dashed line in FIG. 1. In FIG. 1, a vertically downward direction is defined as a gravity direction, and two horizontal directions opposite to each other are defined as a first direction X and a second direction Y.

The liquid ejecting head 13 performs printing by ejecting liquid to a medium S while in the first posture. In the present embodiment, a position where the medium S receives the liquid is referred to as a recording position. The maintenance apparatus 31 performs maintenance when the liquid ejecting head 13 is in the second posture. The first posture is, for example, a posture where the opening surface 13*a* of the liquid ejecting head 13 is inclined with respect to horizontal, and the second posture is a posture where the inclination of the opening surface 13*a* with respect to horizontal is smaller than that of the first posture.

In the present embodiment, when the liquid ejecting head 13 is in the second posture, the opening surface 13*a* is close to horizontal. However, the opening surface 13*a* need not necessarily be close to horizontal, but may be closer to horizontal than in the first posture. In other words, "the inclination of the opening surface 13*a* with respect to horizontal is smaller than that of the first posture" includes a case where the inclination of the opening surface 13*a* with respect to horizontal is zero and the opening surface 13*a* is horizontal.

In the present embodiment, a direction in which the medium S advances in the recording position is defined as a transport direction F, and a direction in which the liquid ejecting head 13 in the first posture ejects liquid is defined as an ejecting direction J. A direction different from both the transport direction F and the ejecting direction J is defined as a width direction W. Further, a length in the width direction W may be referred to as a "width". The liquid ejecting head 13 of the present embodiment is a line head having a plurality of nozzles 14 arranged so that a printing range in the width direction W is greater than or equal to a width of the medium S.

The housing 12 is provided with a mounting portion 20. The mounting portion 20 is mounted with one or a plurality (four in the present embodiment) of liquid containers 19. The liquid container 19 may be an attachable and detachable cartridge or may be a tank into which liquid is injected.

The liquid ejecting apparatus 11 includes a supply flow path 21 arranged so as to supply liquid to the liquid ejecting head 13, a pressurizing mechanism 22 that can pressurize the inside of the supply flow path 21, an opening/closing mechanism 24 that can open and close the supply flow path 21 on the downstream side of the pressurizing mechanism 22. When the opening/closing mechanism 24 is a first opening/closing mechanism 24, the liquid ejecting apparatus 11 may include an opening/closing mechanism 23 as a second opening/closing mechanism 23 that can open and close the supply flow path 21 on the upstream side of the pressurizing mechanism 22. The opening/closing mechanisms 23 and 24 are, for example, valves that can forcibly open and close the supply flow path 21.

The pressurizing mechanism 22 includes a liquid chamber 22*a* provided in the middle of the supply flow path 21 and a drive mechanism 25 that pressurizes the liquid chamber 22*a* from the outside of the supply flow path 21. The liquid chamber 22*a* includes an atmosphere opening valve 22*b*. When the atmosphere opening valve 22*b* is opened, the inside of the liquid chamber 22*a* is opened to the atmosphere. The drive mechanism 25 is configured to send gas to the inside of the liquid chamber 22*a*. The drive mechanism 25 is, for example, a pump that sends out gas through a gas sending pipe 25*a*. When the drive mechanism 25 sends gas to the inside of the liquid chamber 22*a* trough the atmosphere opening valve 22*b*, the liquid inside the liquid chamber 22*a* is pressurized. When the atmosphere opening valve 22*b* is opened, pressure inside the liquid chamber 22*a* becomes the atmospheric pressure and the pressurization of the liquid chamber 22*a* is released.

The liquid ejecting apparatus 11 includes a moving mechanism 34 that moves the maintenance apparatus 31 along the second direction Y and a control unit 100. The control unit 100 controls operations of the liquid ejecting head 13, the maintenance apparatus 31, and the opening/closing mechanisms 23 and 24.

Next, a configuration of the maintenance apparatus 31 will be illustrated.

The maintenance apparatus 31 includes a wiping member 32 that can wipe the opening surface 13*a* along with movement relative to the liquid ejecting head 13 and a cap 33 that receives liquid discharged from the nozzles 14, and a suction mechanism 36 that sucks the inside of the cap 33. The suction mechanism 36 includes a suction flow path 35 that connects the cap 33 and a waste liquid container 37. The wiping member 32 is preferable to be formed of an elastically deformable plate-shaped member such as, for example, a rubber member and an elastomer. However, the wiping member 32 may be formed of a liquid-absorbable cloth such nonwoven fabric, a porous material, or the like.

Maintenance operations performed by the maintenance apparatus 31 include flashing, capping, cleaning, and wiping.

The flashing is an operation where the liquid ejecting head 13 discharges liquid as waste liquid by ejecting liquid from the nozzles 14.

The capping is performed when the cap 33 is located below the liquid ejecting head 13 as shown by a chain double-dashed line in FIG. 1. When the capping is performed, the cap 33 moves upward and forms a closed space between the cap 33 and the opening surface 13*a*. In this way, the cap 33 is configured so as to form the closed space to which the nozzles 14 open. A position of the maintenance apparatus 31 when the capping is performed is referred to as a capping position. The capping is performed to prevent drying of the nozzles 14 when the liquid ejecting head 13 stops a liquid ejecting operation as well as when the power is off.

The cleaning is a maintenance operation for discharging foreign objects such as bubbles by outputting liquid from the nozzles 14. Types of the cleaning include suction cleaning, choke cleaning, and pressurized cleaning.

When performing the suction cleaning, first, the cap 33 moves upward and performs the capping. When the suction mechanism 36 is driven in a state in which the cap 33 forms a closed space between the cap 33 and the opening surface 13*a*, foreign objects such as bubbles located inside the liquid ejecting head 13 are discharged from the nozzles 14 along with liquid.

The choke cleaning is a kind of suction cleaning. The choke cleaning is an operation that closes the supply flow path 21 and drives the suction mechanism 36 as well as performs capping. For example, when the first opening/closing mechanism 24 is closed and the suction mechanism 36 is driven, the pressure of a region from the nozzles 14 to the first opening/closing mechanism 24 becomes negative pressure and the size of bubbles located in the region increase. Thereafter, when the supply flow path 21 is opened, the bubbles flow downstream. Therefore, the choke cleaning is suitable for discharging bubbles accumulated in the liquid ejecting head 13 and the like.

In the pressurized cleaning, liquid is discharged from the nozzles 14 by pressurizing the inside of the supply flow path 21. The cleaning is performed when the cap 33 is located below the liquid ejecting head 13. A position of the maintenance apparatus 31 when the cleaning is performed is referred to as a receiving position (position shown by a chain double-dashed line in FIG. 1). The cleaning is performed before starting print processing or after performing print processing.

The wiping is a maintenance operation to wipe the opening surface 13*a* when the wiping member 32 moves relative to the liquid ejecting head 13. In the present embodiment, when the maintenance apparatus 31 including the wiping member 32 moves in a direction opposite to the second direction Y from the receiving position, a tip portion of the wiping member 32 wipes the opening surface 13*a*.

It is preferable that the wiping is performed when liquid, dust, or the like is attached to the liquid ejecting head 13. For example, after the cleaning, liquid discharged from the nozzles 14 is attached to the opening surface 13*a*, so that it is preferable to perform the wiping. Further, when the liquid ejecting head 13 ejects liquid to the medium S, fine mist is generated following the ejection and the mist attaches to the opening surface 13*a*. Therefore, when the print processing continues for a long time, it is preferable to perform the wiping at predetermined timings during the print processing.

Next, pressurized wiping performed under control of the control unit 100 will be described.

The pressurized wiping is wiping performed by wetting the opening surface 13*a* by outputting liquid from the nozzles 14 by pressurization.

First, the pressurizing mechanism 22 pressurizes the inside of the supply flow path 21 in a state in which the first opening/closing mechanism 24 and the second opening/ closing mechanism 23 close the supply flow path 21. After the pressurization, the first opening/closing mechanism 24 opens the supply flow path 21. Then, pressurized liquid flows out of the nozzles 14.

The first opening/closing mechanism 24 closes the supply flow path 21 again after the first opening/closing mechanism 24 opens the supply flow path 21, a predetermined period of time elapses, and the liquid has been outputted. After a predetermined period of time elapses from when the first opening/closing mechanism 24 opens the supply flow path 21, and the liquid has been outputted, the first opening/closing mechanism 24 closes the supply flow path 21 again. After the first opening/closing mechanism 24 closes the supply flow path 21 in this way, the wiping member 32 wipes the opening surface 13*a*. When the second opening/closing mechanism 23 is provided in the supply flow path 21 and the second opening/closing mechanism 23 is closed while the pressurizing mechanism 22 pressurizes the inside of the supply flow path 21, the liquid does not flow upstream, so that it is possible to efficiently pressurize the inside of the nozzles 14.

Besides the pressurized wiping, it is possible to perform pressurized cleaning when the first opening/closing mechanism 24 opens the supply flow path 21 and the first opening/closing mechanism 24 closes the supply flow path 21 again after a predetermined period of time elapses and the liquid has been outputted. After the pressurized cleaning, it is preferable to wipe the opening surface 13*a* to which the liquid is attached by using the wiping member 32.

It is possible to perform the pressurized cleaning and the pressurized wiping in the same manner. However, to perform in particular the pressurized cleaning, the amount of liquid to be discharged or an execution timing may be changed from those of the pressurized wiping. For example, in the pressurized cleaning, the amount of discharged liquid may be increased by increasing a pressurizing force to grater than that in the pressurized wiping. Alternatively, the execution timing may be varied in such a way that the pressurized cleaning is performed when resuming printing after a long non-operational state and the pressurized wiping is performed after executing printing.

Next, operations and effects of the liquid ejecting apparatus 11 of the present embodiment will be described.

When the first opening/closing mechanism 24 is opened after the first opening/closing mechanism 24 is closed and pressurization is performed, a flowing speed of liquid flowing toward the nozzles 14 becomes faster than that in a case where the pressurization is performed without closing the first opening/closing mechanism 24.

When performing cleaning, if the flowing speed of liquid is increased or a shock is given by rapid pressure fluctuation, bubble dischargeability is improved. Therefore, according to the present embodiment, it is possible to efficiently discharge foreign objects and the like in the nozzles 14. When there are a large number of nozzles 14, it is possible to evenly apply a pressurizing force to each of the nozzles 14 by opening the supply flow path 21 after closing and pressurizing the supply flow path 21.

When the opening/closing mechanism 24 closes the supply flow path 21 after a predetermined period of time elapses after the liquid is flown out of the nozzles 14, the flowing out of the liquid stops. When the wiping is performed in this state, the liquid flown out of the nozzles 14 is attached to the opening surface 13*a*, so that the opening surface 13*a* is not easily damaged and it is possible to dissolve the solidified foreign objects it in a liquid and remove the foreign objects. Further, during the wiping, the supply flow path 21 is closed, so that the liquid is not easily flown out unnecessarily even when the wiping member 32 comes into contact with a liquid surface in the nozzles 14.

Second Embodiment

Next, a second embodiment of the liquid ejecting apparatus will be described.

In the following description, components denoted by the same reference numerals have the same functions as those of the components described above, so that the description thereof will be omitted and new components will be mainly described. Portions having similar components in different embodiments can be exchanged and implemented.

Figure 2:
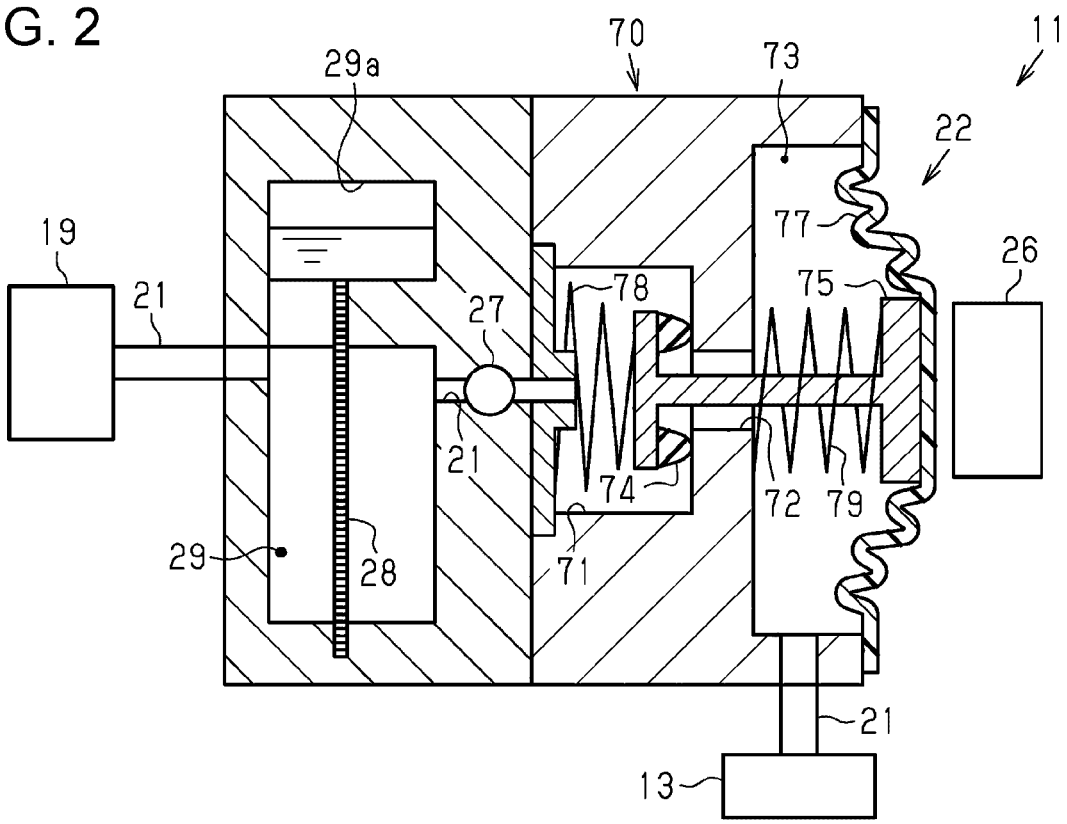
FIG. 2 is an entire configuration diagram of a liquid ejecting apparatus of a second embodiment.

As shown in FIG. 2, the pressurizing mechanism 22 of the present embodiment includes a liquid chamber 73 provided in the middle of the supply flow path 21 and a drive mechanism 26 that pressurizes the liquid chamber 73 from the outside of the supply flow path 21. At least a part of a wall surface of the liquid chamber 73 includes a flexible film 77 that can be bent and displaced, and the drive mechanism 26 is configured to displace the flexible film 77 by pressing the flexible film 77.

The supply flow path 21 of the present embodiment is provided with a pressure adjusting mechanism 70. The pressure adjusting mechanism 70 is configured to adjust pressure of the liquid supplied to the liquid ejecting head 13. It is preferable that the pressure adjusting mechanism 70 shares some components (at least the liquid chamber 73 and the flexible film 77) with the pressurizing mechanism 22. The pressure adjusting mechanism 70 has a valve body 74 that opens and closes the supply flow path 21 by interlocking with displacement of the flexible film 77.

The pressure adjusting mechanism 70 includes a supply chamber 71 provided in the middle of the supply flow path 21, a liquid chamber 73 that can communicate with the supply chamber 71 through a communication hole 72, and a pressure receiving member 75 whose proximal end is contained in the supply chamber 71 and whose distal end is contained in the liquid chamber 73. The valve body 74 is an elastic body that opens and closes the communication hole 72 according to displacement of the pressure receiving member 75. The valve body 74 is attached to the proximal end portion of the pressure receiving member 75 which is located in the supply chamber 71.

A part of the wall surface of the liquid chamber 73 is formed of the flexible film 77. The pressure adjusting mechanism 70 includes a first energizing member 78 contained in the supply chamber 71 and a second energizing member 79 contained in the liquid chamber 73. The first energizing member 78 energizes the valve body 74 in a direction to close the communication hole 72 through the pressure receiving member 75.

The pressure receiving member 75 is displaced by being pressed by the flexible film 77 that is bent and displaced in a direction to reduce the volume of the liquid chamber 73. The flexible film 77 is bent and displaced in the direction to reduce the volume of the liquid chamber 73 when the internal pressure of the liquid chamber 73 is lowered according to discharge of liquid from the nozzles 14. Then, when a pressure (internal pressure) applied to an inner surface of the flexible film 77, which is a surface facing the liquid chamber 73, becomes lower than a pressure (external pressure) applied to an outer surface of the flexible film 77, which is a surface opposite to the liquid chamber 73, and when a difference between the pressure applied to the inner surface and the pressure applied to the outer surface becomes greater than or equal to a predetermined value Pn (for example, 1 kPa), the pressure receiving member 75 is displaced and the valve body 74 is switched from a valve closed state to a valve open state.

The predetermined value Pn mentioned here is a value determined according to the energizing forces of the first energizing member 78 and the second energizing member 79, a force required to displace the flexible film 77, a pressing force (sealing load) required to close the communication hole 72 by the valve body 74, a pressure in the supply chamber 71 that is applied to the pressure receiving member 75 in the supply chamber 71 and a surface of the valve body 74, and a pressure in the liquid chamber 73. Here, the greater the sum of the energizing forces of the first energizing member 78 and the second energizing member 79, the greater the predetermined value Pn. The energizing forces of the first energizing member 78 and the second energizing member 79 are set so that, for example, the pressure in the liquid chamber 73 becomes a negative pressure (for example, −1 kPa when the pressure applied to the outer surface of the flexible film 77 is the atmospheric pressure) within a range where a meniscus (a liquid surface curved in a concave shape) can be formed on a gas-liquid interface in the nozzle 14.

When the communication hole 72 is opened and liquid flows into the liquid chamber 73 from the supply chamber 71, the internal pressure of the liquid chamber 73 rises. When the internal pressure of the liquid chamber 73 reaches about −1 kPa corresponding to the above-mentioned predetermined value Pn, the valve body 74 closes the communication hole 72. Therefore, the pressure in a region from the liquid chamber 73 to the nozzles 14 is maintained at about −1 kPa. In this way, the valve body 74 autonomously opens and closes the communication hole 72 according to a differential pressure between the external pressure of the liquid chamber 73 (the atmospheric pressure) and the internal pressure of the liquid chamber 73. Therefore, the pressure adjusting mechanism 70 is classified into a differential pressure valve (in particular, a pressure reduction valve among differential pressure valves), and the valve body 74 functions as a pressure adjusting valve that can open and close so as to adjust the pressure of liquid supplied to the liquid ejecting head 13.

The drive mechanism 26 is configured to move the valve body 74 and forcibly open the communication hole 72 by pressing the pressure receiving member 75 from the outside of the liquid chamber 73 over the flexible film 77. When the drive mechanism 26 displaces the flexible film 77 to the inside of the liquid chamber 73 during maintenance by the operation of the drive mechanism 26 described above, the inside of the supply flow path 21 is pressurized by the liquid flown out of the liquid chamber 73. Thereby, it is possible to eject liquid from the nozzles 14 and perform the pressurized cleaning or the pressurized wiping.

A filter 28 provided upstream of the pressurizing mechanism 22 and a filter chamber 29 where the filter 28 is arranged may be provided in the middle of the supply flow path 21 of the present embodiment. The filter chamber 29 is divided into a primary side (upstream side) and a secondary side (downstream side) by the filter 28. A bubble chamber **29*a* is provided at an upper region of the primary side of the filter chamber 29. Bubbles collected by the filter 28 enter the bubble chamber 29*a*** by buoyancy.

A one-way valve 27 is provided between the pressure adjusting mechanism 70 and the filter 28 in the supply flow path 21 of the present embodiment. The one-way valve 27 allows liquid to flow downstream and controls liquid to flow upstream. When the filter 28 and the filter chamber 29 are not provided, the one-way valve 27 may be arranged upstream the pressurizing mechanism 22 in the supply flow path 21.

Next, operations and effects of the liquid ejecting apparatus 11 of the present embodiment will be described.

When there is the pressure adjusting mechanism 70 in the supply flow path 21, while the valve body 74 is open, a predetermined negative pressure is maintained in a region from the liquid chamber 73 to the nozzles 14. Thereby, liquid dripping from the nozzles 14 is suppressed and a liquid ejecting operation is stabilized.

When the drive mechanism 26 presses the flexible film 77 which is a part of the pressure adjusting mechanism 70, the valve body 74 is forcibly opened and the inside of the nozzles 14 is pressurized. At this time, if there is the one-way valve 27 on the upstream side of the pressure adjusting mechanism 70, the liquid in the liquid chamber 73 is prevented from flowing upstream and flows toward the downstream side. Therefore, the inside of the nozzles 14 is efficiently pressurized.

Liquid is temporarily retained in the supply chamber 71 and the liquid chamber 73, so that bubbles are easily accumulated. If there are bubbles in the liquid, when the flexible film 77 is displaced to the inside of the liquid chamber 73, the bubbles are compressed, so that the liquid becomes less pressurized. In this regard, when the filter 28 and the bubble chamber **29*a* are arranged on the upstream side of the pressure adjusting mechanism 70, bubbles are hardly accumulated in the supply chamber 71 and the liquid chamber 73, so that the pressurizing force is stabilized. Further, when the one-way valve 27 is arranged between the liquid chamber 73 and the filter chamber 29, the pressurizing force does not reach the bubble chamber 29*a*** containing bubbles, so that it is possible to avoid reduction of the pressurizing force due to the presence of bubbles.

Increase in flow path resistance is suppressed by using the liquid chamber 73 of the pressure adjusting mechanism 70 also as the liquid chamber 73 of the pressurizing mechanism 22. Further, upsizing of the apparatus is suppressed by incorporating the pressurizing mechanism 22 into the pressure adjusting mechanism 70.

As a first modified example of the present embodiment, the one-way valve 27 may be modified to the opening/closing mechanism 23 (see FIG. 1) that can be operated to be open and close. In this case, the opening/closing mechanism 23 closes the supply flow path 21, and thereby the choke cleaning can be performed. When the opening/closing mechanism 23 closes the supply flow path 21 and the suction mechanism 36 (see FIG. 1) is driven, a negative pressure reaches a region from the nozzles 14 to the opening/closing mechanism 23. Therefore, it is possible to discharge the bubbles accumulated in the supply chamber 71 and the liquid chamber 73 in addition to the bubbles accumulated in the liquid ejecting head 13.

As a second modified example of the present embodiment, the opening/closing mechanism 24 (see FIG. 1) that can be operated to be open and close may be provided on the downstream side of the pressurizing mechanism 22. In this case, it is possible to perform the choke cleaning, the pressurized cleaning, and the pressurized wiping, which are performed when the opening/closing mechanism 24 closes the supply flow path 21.

As a third modified example of the present embodiment, the first opening/closing mechanism 24 (see FIG. 1) may be provided on the downstream side of the pressure adjusting mechanism 70 and the pressurizing mechanism 22, and instead of the one-way valve 27, the second opening/closing mechanism 23 (see FIG. 1) may be provided on the upstream side of the pressure adjusting mechanism 70 and the pressurizing mechanism 22. In this case, when an elapsed time from the previous cleaning is short, the choke cleaning may be performed by closing the first opening/closing mechanism 24, and when the elapsed time from the previous cleaning is long, the choke cleaning may be performed by closing the second opening/closing mechanism 23.

Alternatively, after performing first choke cleaning by closing the second opening/closing mechanism 23 on the upstream side, second choke cleaning may be performed by closing the first opening/closing mechanism 24 on the downstream side. By doing so, even when bubbles flowing out from the pressure adjusting mechanism 70 at the first choke cleaning do not reach the outside of the nozzles 14, the bubbles can be discharged to the outside of the nozzles 14 by the second choke cleaning. When combining and performing a plurality of types of cleaning operations in this way, it is possible to effectively discharge foreign objects such as bubbles while reducing the amount of liquid consumed by the cleaning.

As a fourth modified example of the present embodiment, a liquid chamber dedicated for the pressurizing mechanism 22 may be provided separately in the downstream side of the pressure adjusting mechanism 70. In this case, the first opening/closing mechanism 24 (see FIG. 1) may be provided on the downstream side of the liquid chamber dedicated for the pressurizing mechanism 22, and the one-way valve 27 or the second opening/closing mechanism 23 (see FIG. 1) may be provided between the liquid chamber 73 of the pressure adjusting mechanism 70 and the liquid chamber dedicated for the pressurizing mechanism 22. Further, in this case, an opening/closing mechanism may be provided on the upstream side of the pressure adjusting mechanism 70.

Third Embodiment

Next, a third embodiment of the liquid ejecting apparatus will be described.

Figure 3:
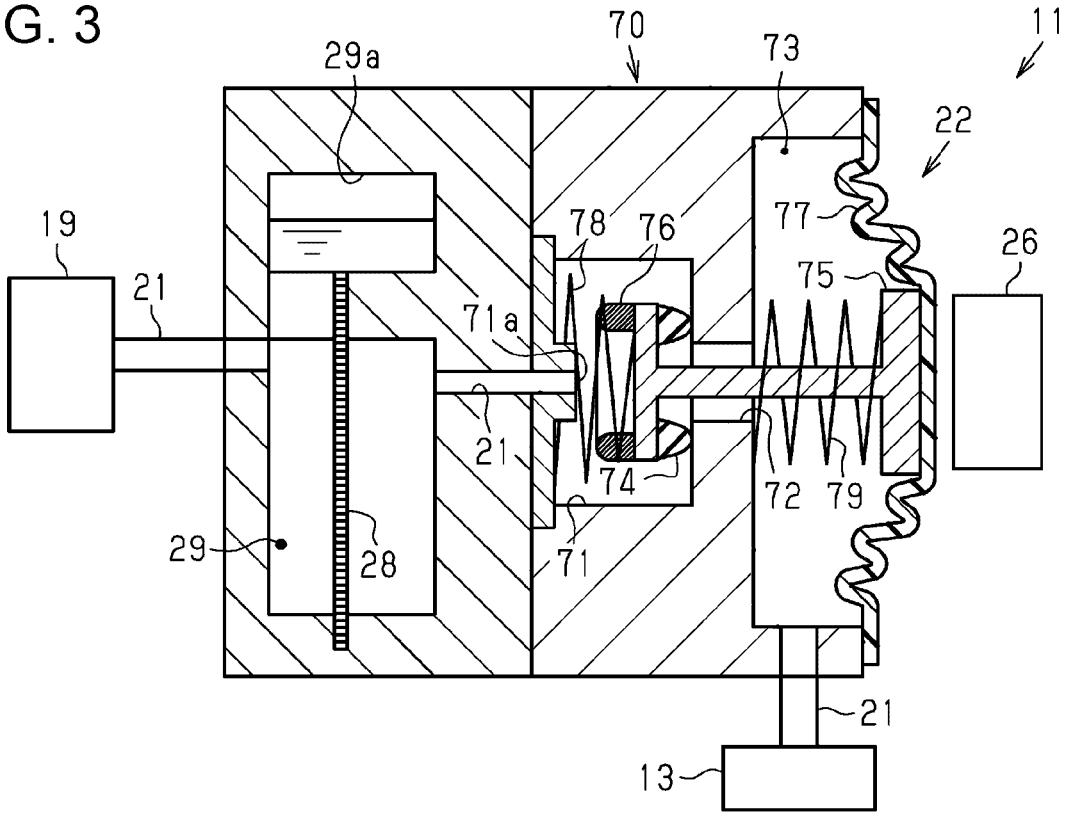
FIG. 3 is an entire configuration diagram of a liquid ejecting apparatus of a third embodiment.

As shown in FIG. 3, the liquid ejecting apparatus 11 of the third embodiment has substantially the same configuration as that of the liquid ejecting apparatus 11 of the second embodiment. However, they are different in that the liquid ejecting apparatus 11 of the third embodiment has a valve body 76, which is attached to a proximal end of the pressure receiving member 75, instead of the one-way valve 27. The valve body 76 is attached to a side of the proximal end of the pressure receiving member 75 opposite to the valve body 74. When the drive mechanism 26 presses the pressure receiving member 75 through the flexible film 77, the valve body 76 closes a liquid inflow port 71*a* to the supply chamber 71.

Next, operations and effects of the liquid ejecting apparatus 11 of the present embodiment will be described.

In the present embodiment, the valve body 76 closes the inflow port 71*a* at a timing at which the drive mechanism 26 performs pressurization. Therefore, liquid that contributes to the pressurization hardly flows toward the filter chamber 29. Further, the valve body 76 is housed in the supply chamber 71, so that it is possible to downsize the apparatus.

Fourth Embodiment

Next, a fourth embodiment of the liquid ejecting apparatus will be described.

Figure 4:
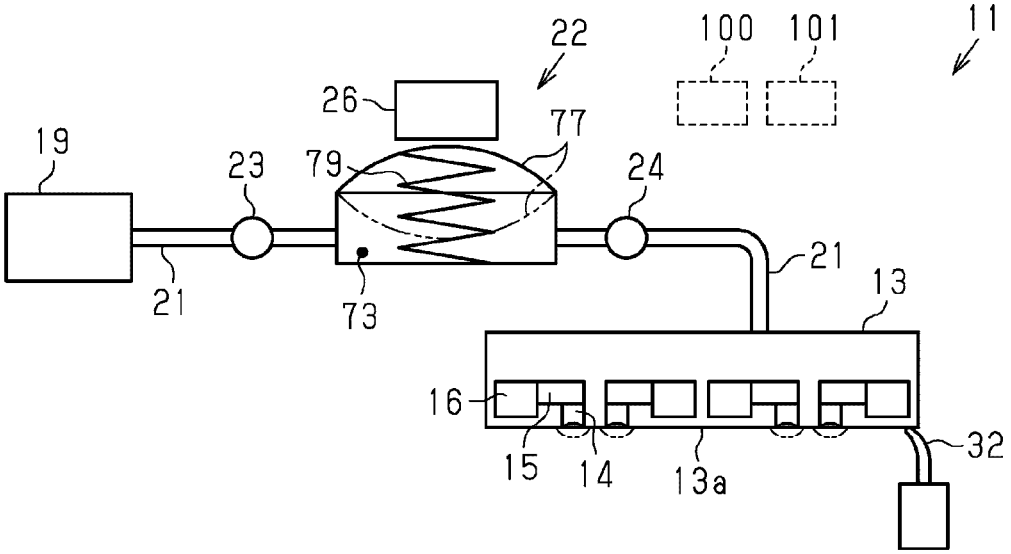
FIG. 4 is an entire configuration diagram of a liquid ejecting apparatus of a fourth embodiment.

As shown in FIG. 4, the liquid ejecting apparatus 11 of the present embodiment includes the liquid ejecting head 13, the supply flow path 21, the pressurizing mechanism 22 that can pressurize the inside of the supply flow path 21, the opening/closing mechanism 24 that can open and close the supply flow path 21 on the downstream side of the pressurizing mechanism 22, the wiping member 32, the control 100 that controls the liquid ejecting head 13 and the pressurizing mechanism 22, and a clocking unit 101.

The clocking unit 101 clocks a time elapsed from when a maintenance operation that causes the liquid ejecting head 13 to eject liquid is performed. The maintenance operation mentioned here is a maintenance operation effective to discharge bubbles. For example, the maintenance operation is the suction cleaning described in the first embodiment (the choke cleaning is more preferable). In the present embodiment, the maintenance operation is referred to as a "bubble discharging operation".

The pressurizing mechanism 22 includes the liquid chamber 73 provided in the middle of the supply flow path 21 and the drive mechanism 26 that pressurizes the liquid chamber 73 from the outside of the supply flow path 21. At least a part of the wall surface of the liquid chamber 73 includes the flexible film 77 that can be bent and displaced, and the drive mechanism 26 is configured to displace the flexible film 77. When the drive mechanism 26 presses the flexible film 77 from the outside of the liquid chamber 73 toward the inside of the liquid chamber 73, the pressurizing mechanism 22 pressurizes the inside of the supply flow path 21.

An energizing member 79 that energizes the flexible film 77 to the outside may be provided in the liquid chamber 73. In this case, when the drive mechanism 26 stops pressing the flexible film 77, the energizing force of the second energizing member 79 can restore the flexible film 77 to the original position (a position shown by a solid line in FIG. 4) from a position shown by a chain double-dashed line in FIG. 4.

When the opening/closing mechanism 24 is a first opening/closing mechanism 24, it is preferable that the liquid ejecting apparatus 11 includes a second opening/closing mechanism 23 that is an opening/closing mechanism 23 that can open and close the supply flow path 21 on the upstream side of the pressurizing mechanism 22. When the second opening/closing mechanism 23 closes the supply flow path 21 while the pressurizing mechanism 22 pressurizes the inside of the supply flow path 21, the liquid hardly flows back upstream. Therefore, a pressurizing force generated in association with the displacement of the flexible film 77 is concentrated to the nozzles 14 located in the downstream side.

The liquid ejecting head 13 has a plurality of (for example, four) nozzle groups, each of which includes a plurality of nozzles 14 that eject the same type of liquid (for example, ink of the same color). The liquid ejecting head 13 includes cavities 15 that respectively communicate with the nozzles 14 and a common liquid chamber 16 that communicates with the plurality of cavities 15. The common liquid chamber 16 is provided for each nozzle group.

The pressure in the liquid ejecting head 13 is also an internal pressure of the cavity 15 or the common liquid chamber 16. In a space where liquid is temporarily accumulated, such as the cavity 15 or the common liquid chamber 16, a region occurs where liquid hardly flows, so that foreign objects such as bubbles are easily accumulated in the region.

Next, the pressurized wiping of the present embodiment will be described with reference to FIGS. 5 and 6.

Figure 5:
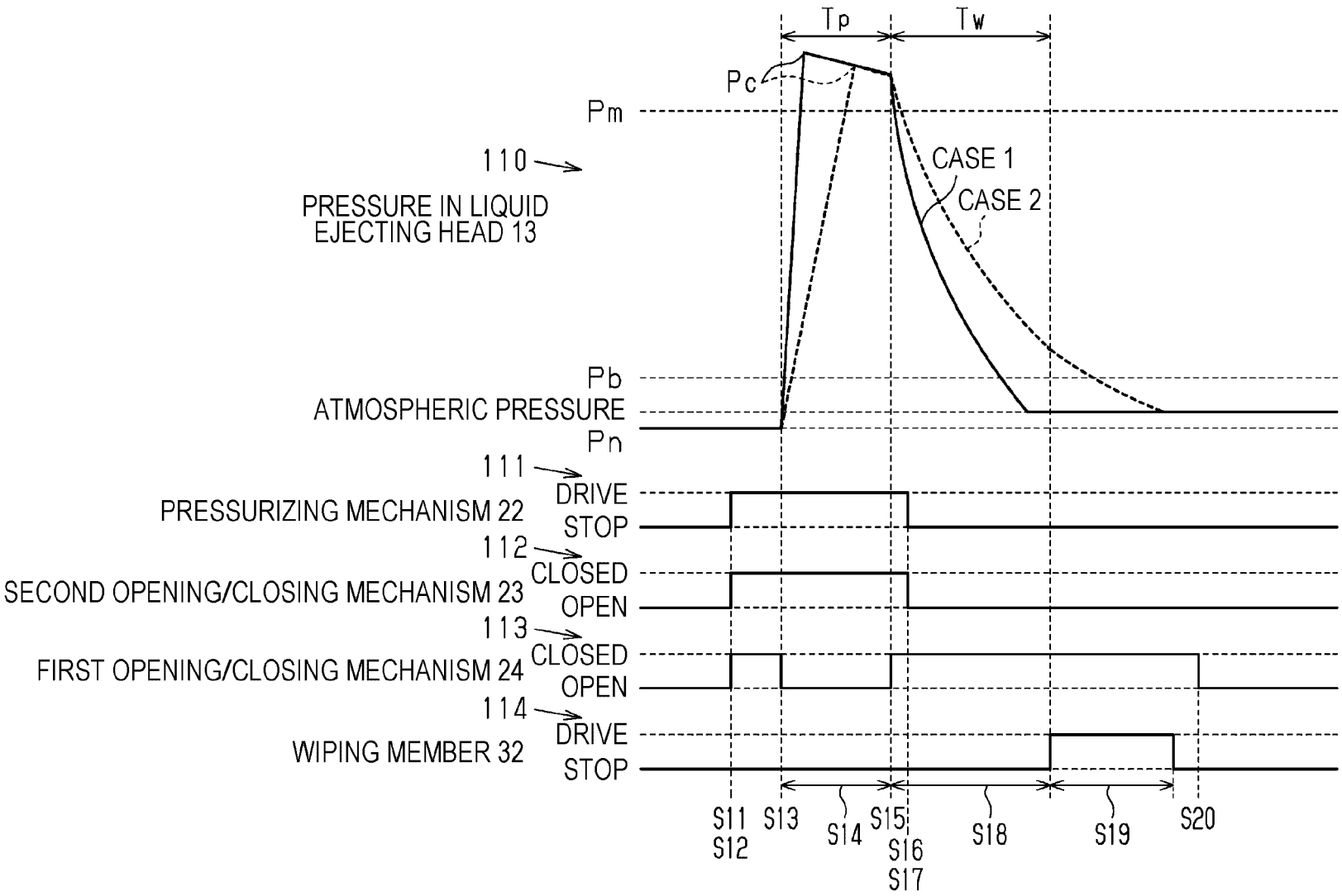
FIG. 5 is a timing chart of pressurized wiping performed by the liquid ejecting apparatus of FIG. 4.
Figure 6:
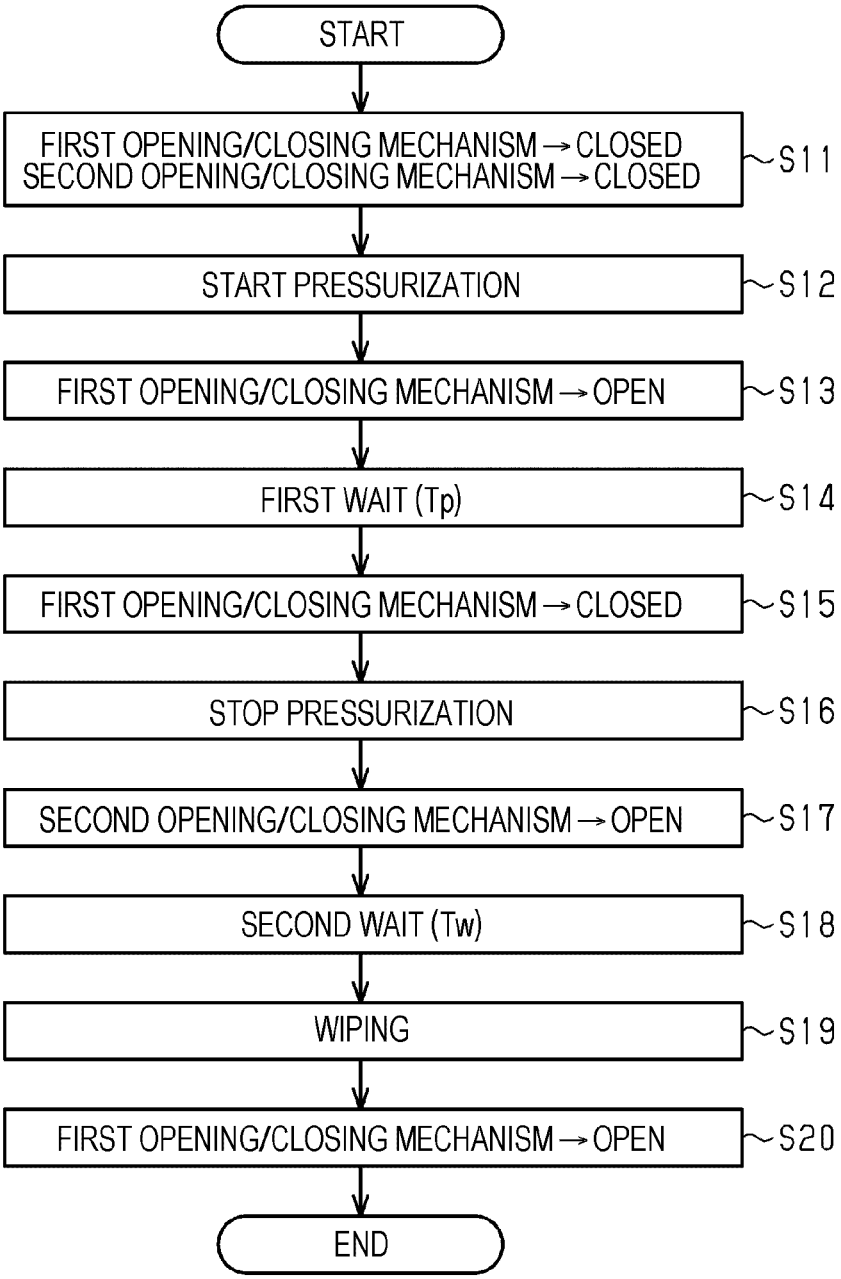
FIG. 6 is a flowchart of pressurized wiping performed by the liquid ejecting apparatus of FIG. 4.

In FIG. 5, a pressure variation in the liquid ejecting head 13 is shown as a graph 110, a driving state of the pressurizing mechanism 22 is shown as a graph 111, an opening/ closing state of the second opening/closing mechanism 23 is shown as a graph 112, an opening/closing state of the first opening/closing mechanism 24 is shown as a graph 113, and an operating state of the wiping member 32 is shown as a graph 114.

When the bubble discharging operation is performed, the clocking unit 101 starts clocking of an elapsed time Tc. Thereafter, a printing operation and the like are performed and the control unit 100 performs the pressurized wiping shown in FIG. 6 at a predetermined timing.

First, as step S11, the first opening/closing mechanism 24 and the second opening/closing mechanism 23 close the supply flow path 21. At the same time as step S11 or immediately after step S11, as step S12, the drive mechanism 26 drives and presses the flexible film 77, so that the pressurizing mechanism 22 starts pressurizing the inside of the supply flow path 21. At this time, the first opening/closing mechanism 24 and the second opening/closing mechanism 23 close the supply flow path 21, so that a region between the first opening/closing mechanism 24 and the second opening/closing mechanism 23 is pressurized.

Subsequently, as step S13, the first opening/closing mechanism 24 opens the supply flow path 21. Then, the pressurizing force reaches the downstream side of the first opening/closing mechanism 24, so that the pressure in the liquid ejecting head 13 rises. The pressurizing force at this time is set so as to exceed a threshold value Pm (see FIG. 5). The threshold value Pm is determined so that when the pressure in the nozzle 14 exceeds the threshold value Pm, the liquid surface protrudes to the outside of the nozzle 14 and the meniscus is broken. A peak value of the pressure when the meniscus is broken is defined as Pc (see FIG. 5).

As step S14, the control unit 100 waits for a predetermined period of time (for example, a waiting time Tp). The waiting time Tp at this time (see FIG. 5) may be set as a required time within which the pressure in the nozzle 14 exceeds the threshold value Pm by the pressurization and as shown by a chain double-dashed line in FIG. 4, the meniscus protruding to the outside of the nozzle 14 is broken and liquid wet-spreads on the opening surface 13*a*. When the meniscus is broken and the liquid is beginning to flow out of the nozzle 14, the pressure in the liquid ejecting head 13 is beginning to fall from a peak value Pc.

Thereafter, as step S15, the first opening/closing mechanism 24 closes the supply flow path 21. Then, the pressurizing force does not reach the liquid ejecting head 13 and the pressure in the liquid ejecting head 13 rapidly falls in association with the leakage of liquid from the nozzles 14. When the pressure in the liquid ejecting head 13 becomes close to the atmospheric pressure, liquid does not flow out of the nozzles 14.

Subsequently, as step S16, the drive mechanism 26 stops driving to stop the pressurization. Further, as step S17, the second opening/closing mechanism 23 opens the supply flow path 21. Steps S16 and S17 may be performed at the same time as step S15.

As step S18, the control unit 100 waits again (second wait). The length of the waiting time at this time is defined as a waiting time Tw (see FIG. 5).

Thereafter, as step S19, the wiping member 32 performs the wiping. When the wiping is completed, the process proceeds to step S20, the first opening/closing mechanism 24 opens the supply flow path 21, and the process is completed.

Here, a case 1 shown by a solid line in FIG. 5 illustrates variation of the pressure in the liquid ejecting head 13 when the elapsed time Tc from the bubble discharging operation is short and there are little bubbles in the liquid ejecting head 13. On the other hand, a case 2 shown by a dashed line in FIG. 5 illustrates variation of the pressure in the liquid ejecting head 13 when the elapsed time Tc from the bubble discharging operation is longer than that in the case 1 and there are many bubbles in the liquid ejecting head 13.

In the case 2, a volume change caused when the bubbles are compressed by the pressurization force is large, so that the pressure in the liquid ejecting head 13 more hardly rises than in the case 1 in a period from when the first opening/closing mechanism 24 opens the supply flow path 21 in step S13 to when the meniscus is broken. Further, in the case 2, a volume change is large, which is caused when bubbles expand, which were compressed after the first opening/closing mechanism 24 closes the supply flow path 21 in step S15, so that it takes a longer time for the pressure in the liquid ejecting head 13 falls than in the case 1.

When the wiping is performed before the pressure in the liquid ejecting head 13 falls sufficiently, liquid flows out of the nozzles 14 even after the wiping is performed, so that liquid is attached to the opening surface 13*a* again. Therefore, it is preferable to start the wiping after the pressure in the liquid ejecting head 13 becomes close to the atmospheric pressure.

On the other hand, when it takes a long time from when the pressure in the liquid ejecting head 13 falls close to the atmospheric pressure to when the wiping is performed, liquids that wet-spread on the opening surface 13*a* are mixed. When it is configured so that a plurality of nozzles 14 eject different types of liquids, different types of liquids enter a nozzle 14. When the liquids are inks of different colors, there is a risk that the inks are mixed in the nozzle 14 to cause degradation of print quality. It is necessary to discharge liquid containing different types of liquids by a maintenance operation such as flashing, so that when mixing of liquids progresses, a large amount of liquid is consumed to discharge the mixed liquids. Therefore, after the pressure in the liquid ejecting head 13 becomes lower than a predetermined value, it is preferable to start the wiping as soon as possible.

For example, the nozzle 14 has a small caliber, so that the flow path resistance is large. Therefore, even when the pressure in the liquid ejecting head 13 is higher than the atmospheric pressure, if the pressure in the liquid ejecting head 13 becomes lower than a predetermined threshold value Pb (see FIG. 5), the liquid hardly flows out of the nozzles 14. Thus, the wiping may be started when the pressure in the liquid ejecting head 13 becomes lower than the threshold value Pb. The threshold value Pb is a value that varies according to the caliber and the length of the nozzle 14. When the pressure in the liquid ejecting head 13 becomes higher than the threshold value Pb, liquid oozes from the nozzle 14.

Therefore, the waiting times Tp and Tw may be changed according to the amount of bubbles, that is, the elapsed time Tc that is clocked by the clocking unit 101. For example, it is preferable that the shorter the elapsed time Tc, the shorter the waiting times Tp and Tw that are set by the control unit 100.

As an essential point of the present embodiment, after the pressurizing mechanism 22 pressurizes the inside of the supply flow path 21, the control unit 100 may cause the wiping member 32 to perform the wiping after elapsing a time within which an appropriate amount of liquid flows out of the nozzles 14. Therefore, after omitting steps S11, S13, S15, S17, and S20 and causing the pressurizing mechanism 22 to perform pressurization, the control unit 100 may cause the wiping member 32 to perform the wiping after waiting for a specified period of time (for example, Tp+Tw). The "specified period of time" is a period of time in consideration of a period of time required to discharge pressurized liquid from the nozzles 14 (the waiting time Tw) in addition to a predetermined period of time required for the liquid to wet-spread on the opening surface 13*a* (the waiting time Tp).

However, when the pressurizing mechanism 22 pressurizes the inside of the supply flow path 21 in a state in which the first opening/closing mechanism 24 closes the supply flow path 21 and thereafter the first opening/closing mechanism 24 opens the supply flow path 21, it is possible to cause the pressurizing force to reach downstream in a short period of time. When a rapid pressure change is caused by pressurization, bubble dischargeability is improved.

When the amount of bubbles is small, the pressurizing force reaches the liquid more easily than when the amount of bubbles is large, so that the threshold value Pm can be exceeded by a smaller force. Therefore, the control unit 100 may change the pressurizing force of the pressurizing mechanism 22 in accordance with the elapsed time Tc. For example, the control unit 100 may change the pressurizing force of the pressurizing mechanism 22 so that the shorter the elapsed time Tc, the smaller the pressurizing force. Alternatively, the control unit 100 may change at least one of the pressurizing force of the pressurizing mechanism 22 and the waiting times Tp and Tw in accordance with the elapsed time Tc. In addition, the control unit 100 may change the pressurizing force or the waiting times Tp and Tw in accordance with the environmental temperature, the viscosity of the liquid, or the like.

The pressurized wiping of the present embodiment can be performed in the liquid ejecting apparatus 11 of the other embodiments. Further, it is possible to change a relationship between the elapsed time Tc and the pressurizing force of the pressurizing mechanism 22 or a relationship between the elapsed time Tc and the waiting times Tp and Tw in accordance with types of cleanings. For example, the bubble dischargeability of the choke cleaning is higher than that of normal suction cleaning. Therefore, even when the elapsed time Tc after the choke cleaning is performed is longer than the elapsed time Tc after the normal suction cleaning is performed, the pressurizing force or the waiting times Tp and Tw may be changed by assuming that the amount of bubbles after the choke cleaning is small.

In addition, when the choke cleaning is performed, bubbles are discharged. Therefore, the amount of bubbles may be estimated based on elapsed time from the choke cleaning. Alternatively, the amount of bubbles may be estimated based on a measurement result of a pressure sensor not shown in the drawings.

Fifth Embodiment

Next, a fifth embodiment of the liquid ejecting apparatus will be described.

Figure 7:
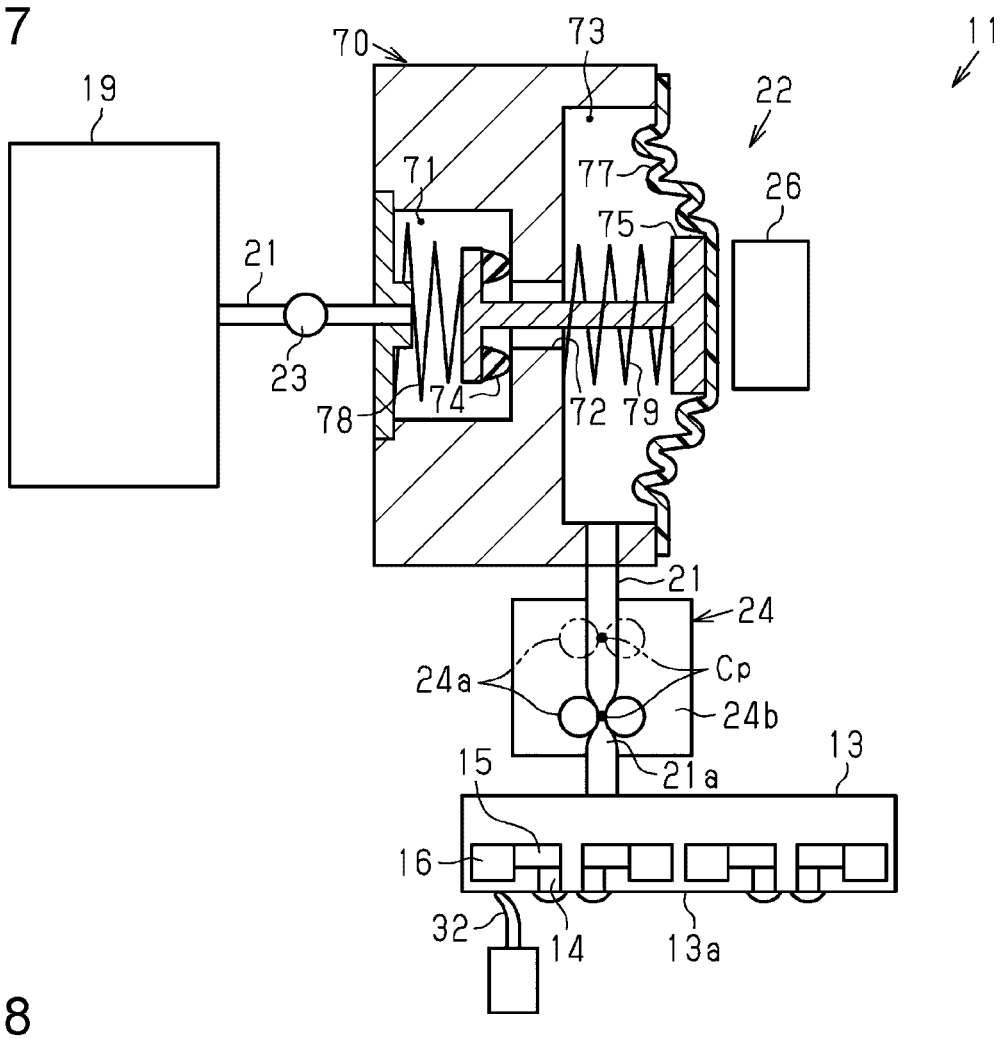
FIG. 7 is an entire configuration diagram of a liquid ejecting apparatus of a fifth embodiment.

As shown in FIG. 7, the liquid ejecting apparatus 11 of the present embodiment includes the liquid ejecting head 13, the supply flow path 21, the first opening/closing mechanism 24 and the second opening/closing mechanism 23 that can open and close the supply flow path 21, the pressure adjusting mechanism 70 provided in the supply flow path 21 between the first opening/closing mechanism 24 and the second opening/closing mechanism 23, and the pressurizing mechanism 22 that shares some components with the pressure adjusting mechanism 70. In the supply flow path 21, at least a portion where the first opening/closing mechanism 24 is arranged is formed of a flexible tube.

The first opening/closing mechanism 24 of the present embodiment has a pressing body 24*a* that can squeeze a tube 21*a* and a moving mechanism 24*b* that moves the pressing body 24*a* along the tube 21*a*. The pressing body 24*a* is, for example, a pair of rollers. When the pair of rollers pinch and squeeze the tube 21*a*, the supply flow path 21 is closed. When the pair of rollers stop the squeezing, the supply flow path 21 is opened. In the first opening/closing mechanism 24, the pair of rollers move along the tube 21*a* in a state in which the pair of rollers close the supply flow path 21, so that it is possible to move a closed position Cp of the supply flow path 21.

Next, the pressurized wiping of the present embodiment will be described with reference to FIGS. 8 and 9.

Figure 8:
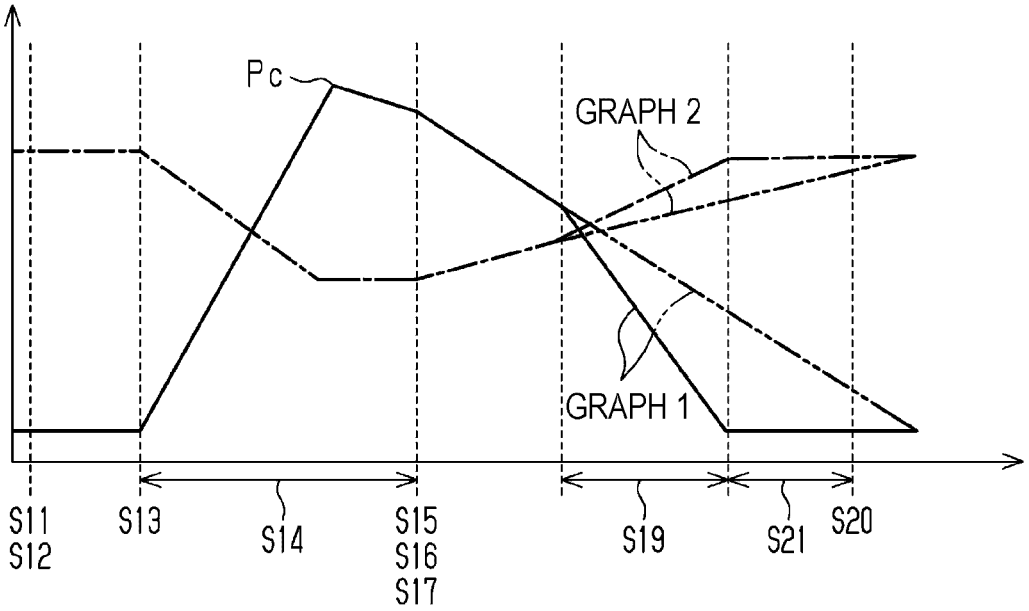
FIG. 8 is a graph showing effects of pressurized wiping performed by the liquid ejecting apparatus of FIG. 7.
Figure 9:
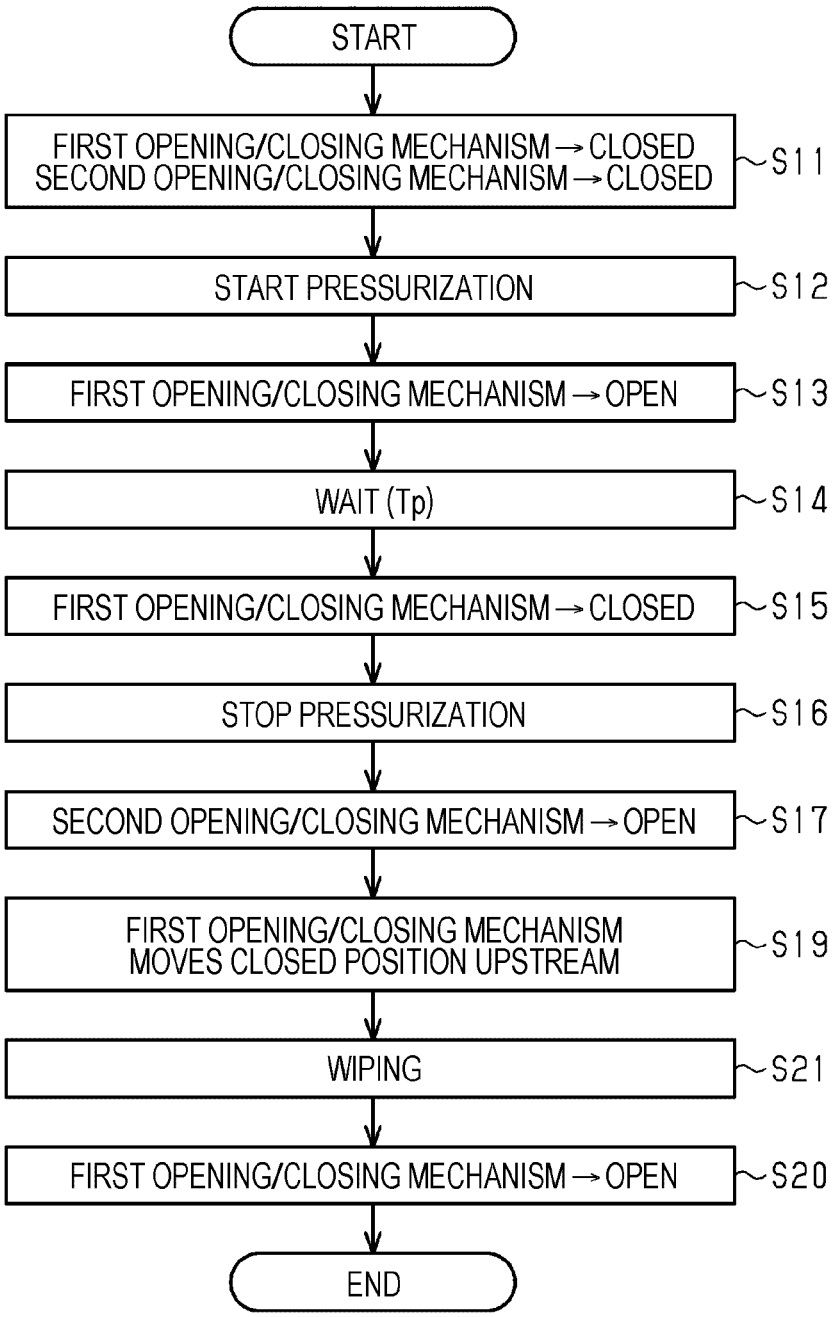
FIG. 9 is a flowchart of pressurized wiping performed by the liquid ejecting apparatus of FIG. 7.

In FIG. 8, graph 1 shows variation of the pressure of the liquid in the liquid ejecting head 13 (the variation is shown by a solid line in FIG. 8), and graph 2 shows variation of the size of the bubbles in the liquid ejecting head 13 (the variation is shown by a dashed-dotted line in FIG. 8). FIG. 9 shows control performed by the control unit 100.

First, in the same manner as in the fourth embodiment, the first opening/closing mechanism 24 and the second opening/closing mechanism 23 close the supply flow path 21 (step S11) and the pressurizing mechanism 22 starts pressurizing the inside of the supply flow path 21 (step S12).

Subsequently, when the first opening/closing mechanism 24 opens the supply flow path 21 (step S13), the pressure in the liquid ejecting head 13 rises. The bubbles in the liquid ejecting head 13 are compressed in accordance with the pressure rise, and the size of the bubbles decreases. While waiting for a predetermined period of time (the waiting time Tp) (step S14), when the pressure in the liquid ejecting head 13 reaches a peak value Pc, the meniscus of the nozzle 14 is broken and the liquid wet-spreads on the opening surface 13*a*. When the meniscus of the nozzle 14 is broken, the liquid flows out of the nozzle 14, the pressure in the liquid ejecting head 13 falls and the size of the babbles in the liquid ejecting head 13 increases.

Thereafter, when the first opening/closing mechanism 24 closes the supply flow path 21 (step S15), the pressure in the liquid ejecting head 13 further falls as the pressurized liquid flows out of the nozzles 14. The size of the bubbles in the liquid ejecting head 13 further increases as the pressure in the liquid ejecting head 13 falls. As the size of the bubbles increases, the amount of liquid flowing out from the nozzles 14 increases. Thereafter, the pressurizing mechanism 22 stops the pressurization (step S16) and the second opening/closing mechanism 23 opens the supply flow path 21 (step S17). Steps S16 and S17 may be performed at the same time as step S15.

Subsequently, the first opening/closing mechanism 24 moves the closed position Cp to an upstream region of the supply flow path 21 (step S19). After the first opening/closing mechanism 24 moves the closed position Cp, the wiping member 32 wipes the opening surface 13*a* (step S21). Thereafter, the first opening/closing mechanism 24 opens the supply flow path 21 (step S20), and the process is completed.

Next, operations and effects of the present embodiment will be described.

In the pressurized wiping of the present embodiment, the pressurizing mechanism 22 pressurizes the inside of the supply flow path 21 in a state in which the opening/closing mechanisms 23 and 24 close the supply flow path 21, and thereafter, the first opening/closing mechanism 24 performs an opening/closing operation that temporarily opens the supply flow path 21 and closes the supply flow path 21 again, and the first opening/closing mechanism 24 moves the closed position Cp to an upstream region of the supply flow path 21 in a state in which the opening/closing mechanism 24 still closes the supply flow path 21. Thereafter, the wiping member 32 wipes the opening surface 13*a*. Therefore, when the wiping member 32 wipes the opening surface 13*a*, the liquid flown out of the nozzles 14 is attached to the opening surface 13*a*, so that it is possible to efficiently clean the opening surface 13*a*. At this time, the first opening/closing mechanism 24 closes the supply flow path 21, so that the liquid is not easily flown out unnecessarily during the wiping and foreign objects such as bubbles are not easily drawn into the nozzles 14.

Further, in the present embodiment, the first opening/closing mechanism 24 moves the closed position Cp to an upstream region of the supply flow path 21 in step S19, so that the pressure in the liquid ejecting head 13 quickly falls without liquid flowing out from the nozzles 14. Thereby, it is possible to prevent the liquid from unnecessarily flowing out due to pressurization. Further, it is not necessary to wait for falling of the pressure in the liquid ejecting head 13 before the wiping (the second wait in step S18 in the fourth embodiment), and accordingly the maintenance time is shortened.

When the first opening/closing mechanism 24 does not move the closed position Cp to an upstream region and gradually releases the pressurization in accordance with leakage of the liquid (shown by a chain double-dashed line in graph 1), the size of the bubbles that are compressed by the pressurization gradually increases in accordance with the release of the pressurization (shown by a chain double-dashed line in graph 2), so that the amount of leaked liquid increases.

As a modified example of the present embodiment, the liquid chamber 22*a* (see FIG. 1) whose inside can be opened to the atmosphere is arranged between the second opening/closing mechanism 23 and the first opening/closing mechanism 24 in the supply flow path 21, and the pressurization may be performed by sending gas to the inside of the liquid chamber 22*a* by means of the drive mechanism 25.

In the fifth embodiment and the modified example described above, instead of the second opening/closing mechanism 23, the one-way valve 27 (see FIG. 2) may be arranged on the upstream side of the pressurizing mechanism 22.

Sixth Embodiment

Next, a sixth embodiment of the liquid ejecting apparatus will be described.

Figure 10:
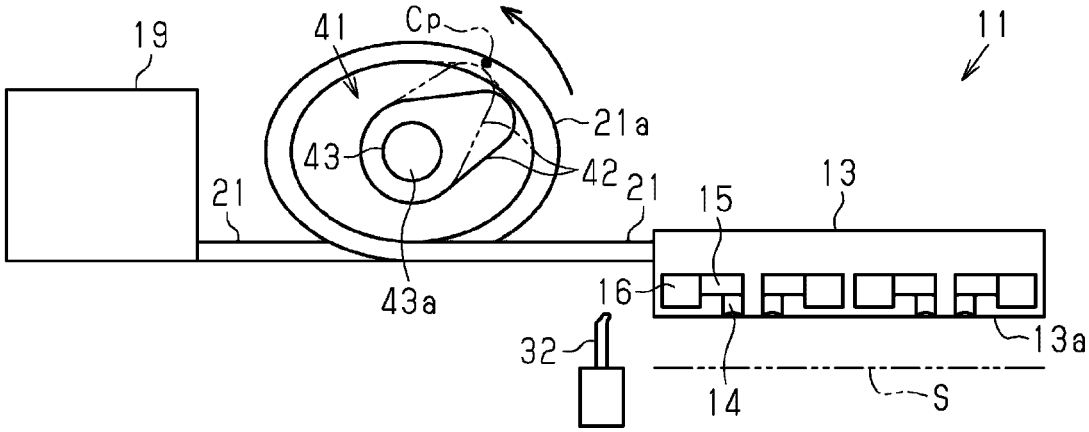
FIG. 10 is an entire configuration diagram of a liquid ejecting apparatus of a sixth embodiment.
Figure 11:
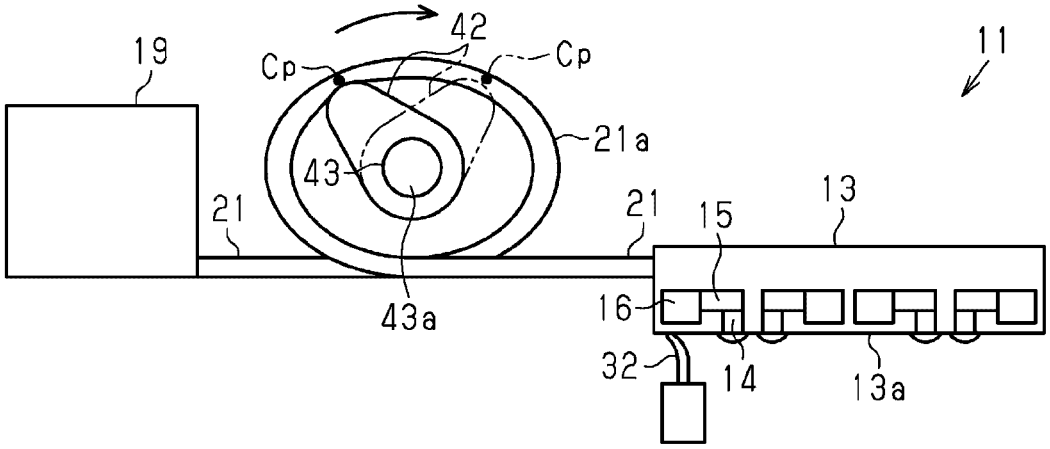
FIG. 11 is an explanatory drawing showing an operation of pressurized wiping performed by the liquid ejecting apparatus of FIG. 10.

As shown in FIGS. 10 and 11, the liquid ejecting apparatus 11 of the present embodiment includes an opening/closing mechanism 41 that can open and close the supply flow path 21. The opening/closing mechanism 41 has a pressing body 42 that can squeeze a portion of a flexible tube 21*a* of the supply flow path 21 and a moving mechanism 43 that moves the pressing body 42 along the tube 21*a*.

The pressing body 42 is, for example, an eccentric cam. The pressing body 42 has a rotating shaft 43*a* that can rotate the pressing body 42, which is an eccentric cam. The pressing body 42 squeezes the tube 21*a* and thereby the opening/closing mechanism 41 closes the supply flow path 21. A position of the pressing body 42 shown by a chain double-dashed line in FIGS. 10 and 11 is a first closed position that closes the supply flow path 21. A position of the pressing body 42 shown by a solid line in FIG. 11 is a second closed position that closes the supply flow path 21. The pressing body 42 that squeezes the supply flow path 21 rotates in a counterclockwise direction shown by an arrow in FIG. 10 between the first closed position and the second closed position or in a clockwise direction (direction shown by an arrow in FIG. 11) opposite to the counterclockwise direction, and thereby the opening/closing mechanism 41 moves the closed position Cp in a state in which the supply flow path 21 is closed. The direction in which the pressing body 42 rotates from the first closed position to the second closed position is a direction toward the downstream side of the supply flow path 21.

The tube 21*a* is an elliptical ring and may be arranged so that the pressing body 42 can rotate to a retreat position where the pressing body 42 does not squeeze the tube 21*a* (a position shown by a solid line in FIG. 10). When the liquid ejecting head 13 ejects liquid to the medium S, the pressing body 42 is disposed at the retreat position and liquid is flown through the supply flow path 21.

Figure 12:
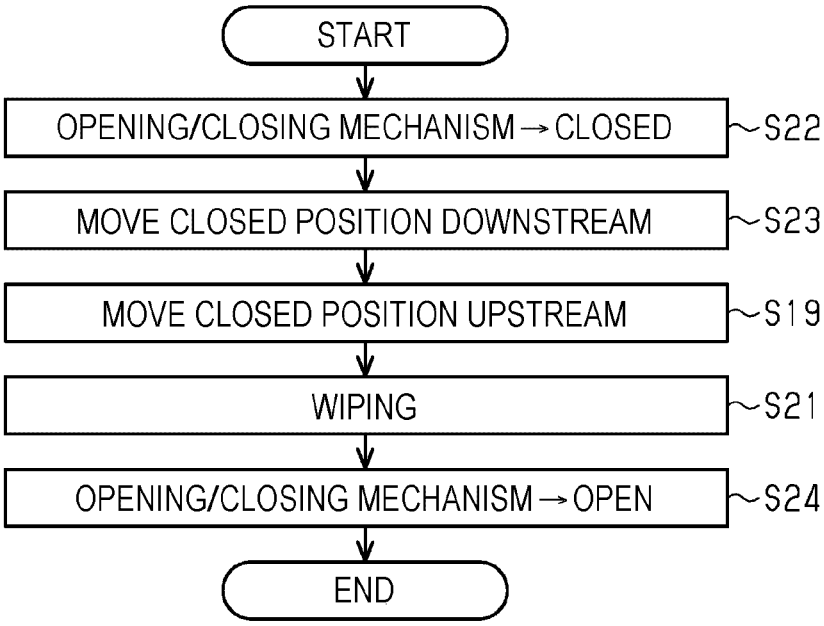
FIG. 12 is a flowchart of pressurized wiping performed by the liquid ejecting apparatus of FIG. 10.

Next, the pressurized wiping of the present embodiment will be described with reference to FIGS. 10, 11, and 12. FIG. 12 shows control performed by the control unit 100.

First, as step S22, the pressing body 42 rotates from the retreat position to the first closed position and closes the supply flow path 21. Next, as step S23, the pressing body 42 rotates from the first closed position to the second closed position and thereby moves the closed position Cp to the downstream side of the supply flow path 21. Thereby, the inside of the liquid ejecting head 13 is pressurized.

After the opening/closing mechanism 41 moves the closed position Cp to the downstream side in this way, as step S19, the pressing body 42 rotates from the second closed position to the first closed position in the clockwise direction shown by the arrow in FIG. 11, so that the opening/closing mechanism 41 moves the closed position Cp to the upstream side of the supply flow path 21. Thereby, the pressure in the liquid ejecting head 13 falls without outputting liquid from the nozzles 14. Thereafter, as step S21, the wiping member 32 wipes the opening surface 13*a*. After the wiping member 32 wipes the opening surface 13*a*, as step S24, the pressing body 42 rotates from the first closed position to the retreat position and thereby the opening/closing mechanism 41 opens the supply flow path 21, and the process is completed.

According to the liquid ejecting apparatus 11 of the present embodiment, the opening/closing mechanism 41 has a function to perform pressurization, so that it is not necessary to have a pressurizing mechanism separately. Accordingly, the configuration can be simplified.

The pressurized wiping of the fourth to the sixth embodiment can be performed as the pressurized cleaning.

Seventh Embodiment

Next, a seventh embodiment of the liquid ejecting apparatus will be described.

In the seventh embodiment, another form of an opening/closing mechanism that can be used for the pressurized wiping and the pressurized cleaning of the fourth to the sixth embodiments will be illustrated.

Figure 13:
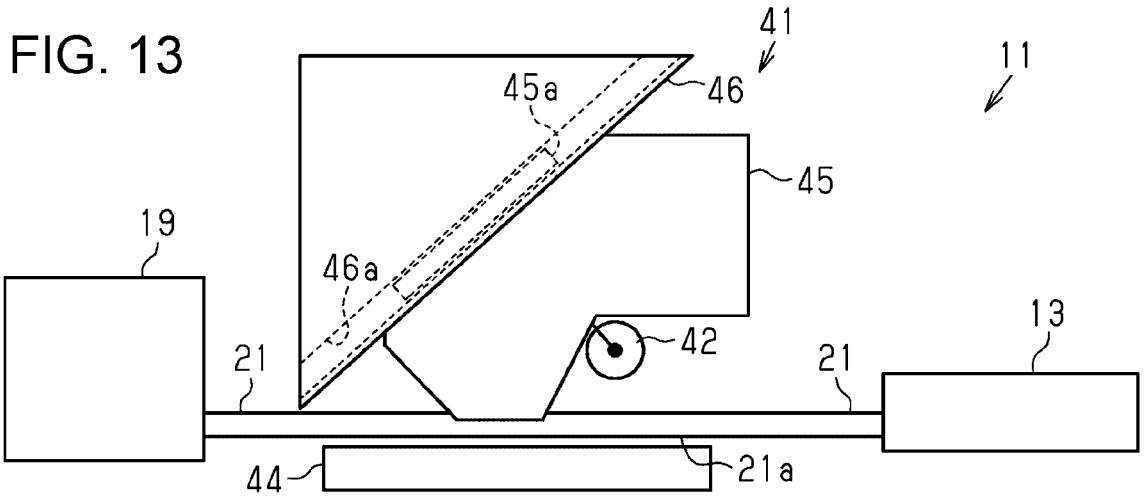
FIG. 13 is an entire configuration diagram of a liquid ejecting apparatus of a seventh embodiment.

As shown in FIG. 13, the opening/closing mechanism 41 of the present embodiment includes a support portion 44 that supports the tube 21*a* that is a part of the supply flow path 21, a roller that is an example of the pressing body 42, a holding member 45 that rotatably holds the pressing body 42, and a guide portion 46 that engages with the holding member 45. The guide portion 46 has an inclined guide 46*a* that obliquely extends with respect to a gravitational direction. The holding member 45 has an engaging portion 45*a* that engages with the inclined guide 46*a*.

During printing or the like, as shown in FIG. 13, the guide portion 46 and the holding member 45 are arranged in a position where the pressing body 42 does not squeeze the tube 21*a*. When the guide portion 46 falls from the position shown in FIG. 13, the holding member 45 engaging with the guide portion 46 and the pressing body 42 held by the holding member 45 also fall.

Figure 14:
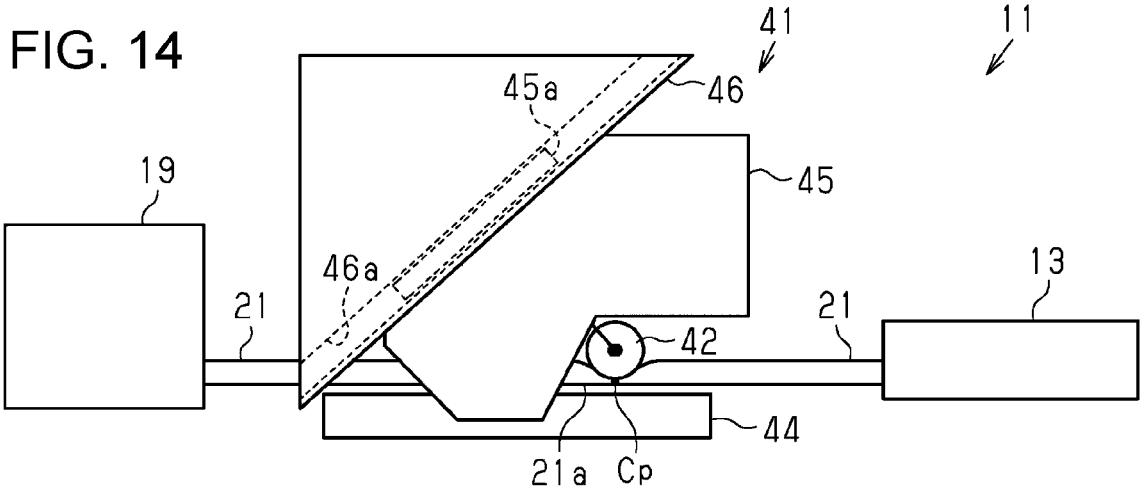
FIG. 14 is an explanatory drawing showing a state in which a supply flow path is closed in the liquid ejecting apparatus of FIG. 13.

As shown in FIG. 14, when the pressing body 42 moves to a position where the pressing body 42 squeezes the tube 21*a*, the opening/closing mechanism 41 closes the supply flow path 21 (step S22 in FIG. 12). When the guide portion 46 further falls from the position shown in FIG. 14, the engaging portion 45*a* is guided by the inclined guide 46*a*, and thereby the holding member 45 and the pressing body 42 move in a first direction indicated by an arrow in FIG. 15. In this way, in a state in which the pressing body 42 still squeezes the tube 21*a*, the pressing body 42 moves from a first closed position shown by a chain double-dashed line in FIG. 15 to a second closed position shown by a solid line in FIG. 15, and thereby the closed position Cp moves downstream (step S23 in FIG. 12).

Figure 15:
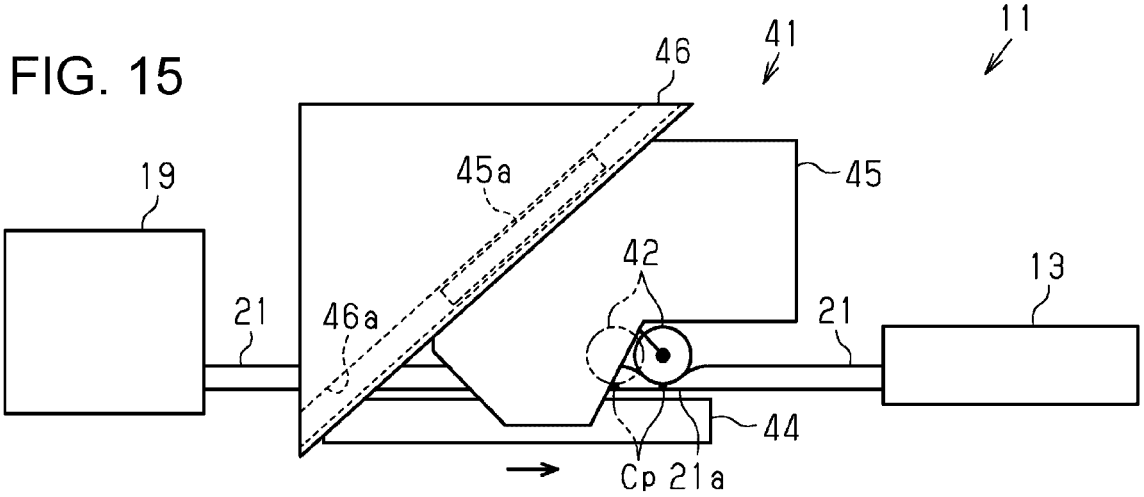
FIG. 15 is an explanatory drawing showing a state in which a closed position of the supply flow path is moved from the state of FIG. 14.

Thereafter, when the guide portion 46 moves upward from the position shown in FIG. 15 to the position shown in FIG. 14, the engaging portion 45*a* is guided by the inclined guide 46*a*, and thereby the holding member 45 and the pressing body 42 move in a second direction opposite to the first direction. In this way, in a state in which the pressing body 42 still squeezes the tube 21*a*, the pressing body 42 moves from the second closed position shown by the solid line in FIG. 15 to the first closed position shown by the chain double-dashed line in FIG. 15, and thereby the closed position Cp moves upstream (step S19 in FIG. 12).

Subsequently, when the guide portion 46 moves upward from the position shown in FIG. 14 to the position shown in FIG. 13, the pressing body 42 stops squeezing the tube 21*a*, so that the supply flow path 21 is opened (step S24 in FIG. 12)

Eighth Embodiment

Next, an eighth embodiment of the liquid ejecting apparatus will be described.

In the eighth embodiment, another form of an opening/closing mechanism that can be used for the pressurized wiping and the pressurized cleaning of the sixth embodiment will be illustrated.

Figure 16:
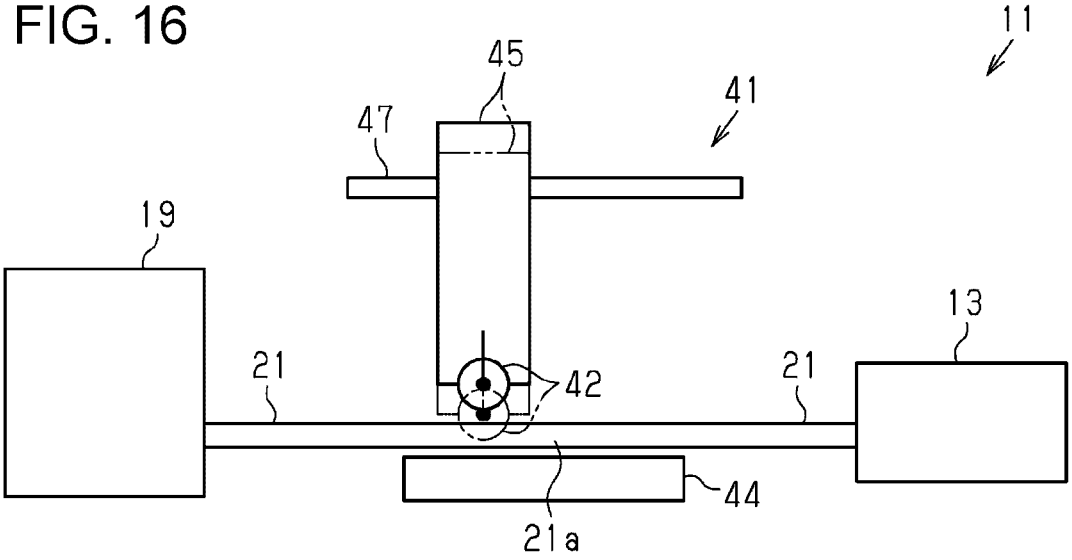
FIG. 16 is an entire configuration diagram of a liquid ejecting apparatus of an eighth embodiment.

As shown in FIG. 16, the opening/closing mechanism 41 of the present embodiment includes the support portion 44 that supports the tube 21*a*, a roller that is an example of the pressing body 42, the holding member 45 that rotatably holds the pressing body 42, and a guide shaft 47 that engages with the holding member 45. The support portion 44 and the guide shaft 47 are arranged so as to extend along the tube 21*a*.

During printing or the like, as shown by a solid line in FIG. 16, the holding member 45 is arranged in a position where the pressing body 42 does not squeeze the tube 21*a*. When the holding member 45 falls from a position shown by a solid line in FIG. 16 to a position shown by a chain double-dashed line in FIG. 16, the pressing body 42 squeezes the tube 21*a*. Thereby, the opening/closing mechanism 41 closes the supply flow path 21 (step S22 in FIG. 12). The closed position Cp at this time is referred to as a first closed position.

Figure 17:
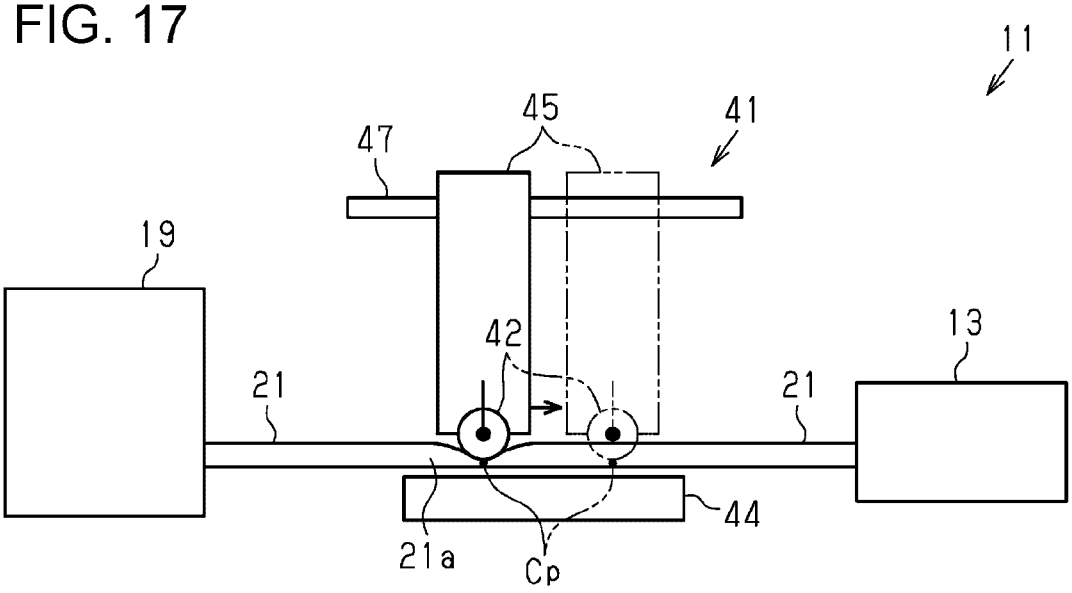
FIG. 17 is an explanatory drawing of a state in which the liquid ejecting apparatus of FIG. 16 moves a closed position of a supply flow path.

In a state in which the pressing body 42 still squeezes the tube 21*a* as shown by a solid line in FIG. 17, when the holding member 45 moves from the first closed position (a position shown by a solid line in FIG. 17) to a second closed position shown by a chain double-dashed line in a first direction indicated by an arrow in FIG. 17 along the guide shaft 47, the closed position Cp moves downstream (step S23 in FIG. 12).

In a state in which the pressing body 42 still squeezes the tube 21*a*, when the holding member 45 moves from the second closed position to the first closed position along the guide shaft 47 in a second direction opposite to the first direction, the closed position Cp moves upstream (step S19 in FIG. 12). Thereafter, when the holding member 45 rises and the pressing body 42 stops the squeezing of the tube 21*a*, the supply flow path 21 is opened (step S24 in FIG. 12).

MODIFIED EXAMPLES

In addition, each embodiment described above may be modified to the modified examples described below. Components included in the above embodiments and components included in the modified examples described below may be arbitrarily combined, or components included in the modified examples described below may be arbitrarily combined.

The opening/closing mechanism 41 of the sixth to the eighth embodiments may be used as the first opening/closing mechanism 24 for performing the pressurized wiping and the pressurized cleaning of the fifth embodiment. Further, the first opening/closing mechanism 24 of the fifth embodiment may be used as the opening/closing mechanism 41 of the sixth to the eighth embodiments.

The liquid ejected from the liquid ejecting head 13 is not limited to ink. For example, the liquid may be a liquid state material where particles of functional materials are dispersed or mixed in a liquid. For example, a liquid state material, where materials such as an electrode material and color materials (pixel materials) used for manufacturing a liquid crystal display, an EL (electroluminescence) display, and a surface-emitting display are dispersed or dissolved, may be ejected to perform recording.

The medium S is not limited to a paper sheet, but may be a plastic film or a thin plate material, or may be a fabric used by a fabric printing apparatus. Further, the medium S may be clothes of an arbitrary shape such as T-shirt or may be a three-dimensional object of an arbitrary shape such as tableware or stationery.

Hereinafter, technical ideas grasped from the above embodiments and modified examples and the effects thereof will be described.

Idea 1

A liquid ejecting apparatus including a liquid ejecting head having nozzles and an opening surface through which the nozzles are opened, the liquid ejecting head being configured to eject liquid from the nozzles, a supply flow path configured to supply the liquid to the liquid ejecting head, a pressurizing mechanism that can pressurize inside of the supply flow path, an opening/closing mechanism that can open and close the supply flow path, and a control unit that controls operations of the liquid ejecting head, the pressurizing mechanism, and the opening/closing mechanism.

Idea 2

The liquid ejecting apparatus described in the [Idea 1], wherein the opening/closing mechanism is provided on a downstream side from the pressurizing mechanism, and the control unit causes the opening/closing mechanism to close the supply flow path, causes the pressurizing mechanism to pressurize the inside of the supply flow path, and thereafter causes the opening/closing mechanism to open the supply flow path, and then causes the opening/closing mechanism to close the supply flow path after a predetermined period of time elapses.

According to the [Idea 2] described above, when the opening/closing mechanism opens the supply flow path that is pressurized by the pressurizing mechanism, pressurized liquid flows out of the nozzles. Thereby, it is possible to efficiently discharge foreign objects and the like in the nozzles. Since the opening/closing mechanism closes the supply flow path after a predetermined period of time elapses, it is possible to prevent the liquid from unnecessarily flowing out due to pressurization.

Idea 3

The liquid ejecting apparatus described in the [Idea 2], further including a wiping member that can wipe the opening surface. In the liquid ejecting apparatus, after the opening/closing mechanism closes the supply flow path, the wiping member wipes the opening surface.

According to the [Idea 3] described above, when the wiping is performed, the liquid flown out of the nozzles is attached to the opening surface, so that it is possible to efficiently clean the opening surface. At this time, the supply flow path is closed, so that the liquid is not easily flown out unnecessarily during the wiping and foreign objects such as bubbles are not easily drawn into the nozzles.

Idea 4

The liquid ejecting apparatus described in any one of the [Idea 1] to the [Idea 3], in which the pressurizing mechanism includes a liquid chamber provided in the middle of the supply flow path and a drive mechanism that pressurizes the liquid chamber from outside the supply flow path.

According to the [Idea 4] described above, the drive mechanism is located outside the liquid chamber, so that the structure of the supply flow path is less likely to be complicated.

Idea 5

The liquid ejecting apparatus described in the [Idea 4], in which at least a part of a wall surface of the liquid chamber includes a flexible film that can be displaced, and the drive mechanism is configured to displace the flexible film.

According to the [Idea 5] described above, it is possible to pressurize the inside of the supply flow path when the drive mechanism displaces the flexible film to the inside of the liquid chamber.

Idea 6

The liquid ejecting apparatus described in the [Idea 5], further including a valve body that opens and closes the supply flow path by interlocking with displacement of the flexible film.

According to the [Idea 6] described above, it is possible to interlock a pressurizing operation with an opening/closing operation of the supply flow path.

Idea 7

The liquid ejecting apparatus described in the [Idea 4], in which inside of the liquid chamber is configured to be able to be opened to the atmosphere, and the drive mechanism is configured to send gas to the inside of the liquid chamber.

According to the [Idea 7] described above, the drive mechanism sends gas to the inside of the liquid chamber, and thereby the supply flow path is pressurized, and the pressurization is released by opening the inside of the liquid chamber 22*a* to the atmosphere.

Idea 8

The liquid ejecting apparatus described in any one of the [Idea 1] to the [Idea 7], further including a second opening/closing mechanism that can open and close the supply flow path on the upstream side from the pressurizing mechanism when the opening/closing mechanism is used as a first opening/closing mechanism. In the liquid ejecting apparatus, the pressurizing mechanism pressurizes the inside of the supply flow path in a state in which the first opening/closing mechanism and the second opening/closing mechanism close the supply flow path.

According to the [Idea 8] described above, the liquid hardly flows back upstream during pressurization.

Idea 9

The liquid ejecting apparatus described in any one of the [Idea 1] to the [Idea 7], further including a one-way valve which is arranged on the upstream side from the pressurizing mechanism in the supply flow path and which allows a flow of the liquid to a downstream side and restricts a flow of the liquid to an upstream side.

According to the [Idea 9] described above, the liquid hardly flows back upstream during pressurization.

Idea 10

The liquid ejecting apparatus described in any one of the [Idea 1] to the [Idea 7], wherein the pressurizing mechanism includes a liquid chamber provided in the middle of the supply flow path, and the liquid ejecting apparatus further includes a filter arranged upstream from the liquid chamber in the supply flow path, a pressure adjusting valve which is arranged in the supply flow path between the filter and the liquid chamber and which can open and close so as to adjust pressure of the liquid supplied to the liquid ejecting head, and a one-way valve which is arranged in the supply flow path between the pressure adjusting valve and the filter and which allows a flow of the liquid to a downstream side and restricts a flow of the liquid to an upstream side.

According to the [Idea 10] described above, the liquid hardly flows back upstream during pressurization.

Idea 11

A maintenance method of a liquid ejecting apparatus that includes a liquid ejecting head having nozzles and an opening surface through which the nozzles are opened, the liquid ejecting head being configured to eject liquid from the nozzles, a supply flow path configured to supply the liquid to the liquid ejecting head, a pressurizing mechanism that can pressurize the inside of the supply flow path, an opening/closing mechanism that can open and close the supply flow path on a downstream side from the pressurizing mechanism, and a control unit that controls operations of the liquid ejecting head, the pressurizing mechanism, and the opening/closing mechanism, the maintenance method including a first closing step in which the control unit operates the opening/closing mechanism to close the supply flow path, a pressure increasing step in which the control unit operates the pressurizing mechanism to increase pressure in the supply flow path, an opening step in which the control unit operates the opening/closing mechanism to open the supply flow path after the pressure increasing step, and a second closing step in which the control unit closes the supply flow path after a predetermined time elapses from the opening step.

According to the [Idea 11] described above, when the opening/closing mechanism opens the supply flow path that is pressurized by the pressurizing mechanism, pressurized liquid flows out of the nozzles. Thereby, it is possible to efficiently discharge foreign objects and the like in the nozzles. Since the opening/closing mechanism closes the supply flow path after a predetermined period of time elapses, it is possible to prevent the liquid from unnecessarily flowing out due to pressurization.

The entire disclosure of Japanese Patent Application No. 2016-238822, filed Dec. 8, 2016 is expressly incorporated by reference herein.

What is claimed is:

1. A liquid ejecting apparatus comprising:

a liquid ejecting head having nozzles and an opening surface through which the nozzles are opened, the liquid ejecting head being configured to eject liquid from the nozzles;

a supply flow path configured to supply the liquid to the liquid ejecting head;

a pressurizing mechanism configured to pressurize inside of the supply flow path;

a first opening/closing mechanism configured to open and close the supply flow path on a downstream side from the pressurizing mechanism;

a second opening/closing mechanism configured to open and close the supply flow path on an upstream side from the pressurizing mechanism; and a control unit that controls operations of the liquid ejecting head, the pressurizing mechanism, the first opening/closing mechanism, and the second opening/closing mechanism.

2. The liquid ejecting apparatus according to claim 1, wherein the control unit causes the first opening/closing mechanism and the second opening/closing mechanism to close the supply flow path, causes the pressurizing mechanism to pressurize the inside of the supply flow path, and thereafter causes the first opening/closing mechanism to open the supply flow path, and then causes the first opening/closing mechanism to close the supply flow path after a predetermined period of time elapses.

3. The liquid ejecting apparatus according to claim 2, further comprising:

a wiping member configured to wipe the opening surface, wherein after the first opening/closing mechanism closes the supply flow path, the wiping member wipes the opening surface.

4. The liquid ejecting apparatus according to claim 2, wherein the pressurizing mechanism includes a liquid chamber provided in the middle of the supply flow path and a drive mechanism that pressurizes the liquid chamber from outside the supply flow path.

5. The liquid ejecting apparatus according to claim 4, wherein at least a part of a wall surface of the liquid chamber includes a flexible film that can be displaced, and the drive mechanism is configured to displace the flexible film.

6. The liquid ejecting apparatus according to claim 5, further comprising:

a valve body that opens and closes the supply flow path by interlocking with displacement of the flexible film.

7. The liquid ejecting apparatus according to claim 4, wherein inside of the liquid chamber is configured to be able to be opened to the atmosphere, and the drive mechanism is configured to send gas to the inside of the liquid chamber.

8. The liquid ejecting apparatus according to claim 2, further comprising:

a one-way valve which is arranged on the upstream side from the pressurizing mechanism in the supply flow path and which allows a flow of the liquid to a downstream side and restricts a flow of the liquid to an upstream side.

9. The liquid ejecting apparatus according to claim 2, wherein the pressurizing mechanism includes a liquid chamber provided in the middle of the supply flow path, and the liquid ejecting apparatus further includes a filter arranged upstream from the liquid chamber in the supply flow path, a pressure adjusting valve which is arranged in the supply flow path between the filter and the liquid chamber and which can open and close so as to adjust pressure of the liquid supplied to the liquid ejecting head, and a one-way valve which is arranged in the supply flow path between the pressure adjusting valve and the filter and which allows a flow of the liquid to a downstream side and restricts a flow of the liquid to an upstream side.

10. A maintenance method of a liquid ejecting apparatus that includes a liquid ejecting head having nozzles and an opening surface through which the nozzles are opened, the liquid ejecting head being configured to eject liquid from the nozzles, a supply flow path configured to supply the liquid to the liquid ejecting head, a pressurizing mechanism configured to pressurize the inside of the supply flow path, a first opening/closing mechanism configured to open and close the supply flow path on a downstream side from the pressurizing mechanism, and a second opening/closing mechanism configured to open and close the supply flow path on an upstream side from the pressurizing mechanism, the maintenance method comprising:

operating the first opening/closing mechanism and the second opening/closing mechanism to close the supply flow path;

operating the pressurizing mechanism to increase pressure in the supply flow path;

operating the first opening/closing mechanism to open the supply flow path after the pressure in the supply flow path increases; and operating the first opening/closing mechanism to close the supply flow path after a predetermined time elapses since the supply flow path is opened.

* * * * *